US006276580B1

(12) United States Patent
Kitahara et al.

(10) Patent No.: US 6,276,580 B1
(45) **Date of Patent: *Aug. 21, 2001**

(54) BAND

(75) Inventors: Masaaki Kitahara, Mizuhomachi; Osami Yamazaki, Fussa; Masahiko Iiyoshi, Kodaira; Hiroki Nishiyama, Fussa, all of (JP)

(73) Assignee: Casio Computer Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/129,352

(22) Filed: Aug. 5, 1998

(30) Foreign Application Priority Data

Aug. 25, 1997 (JP) ..... 9-241721
May 18, 1998 (JP) ..... 10-151944

(51) Int. Cl.[7] ..... A44C 5/00

(52) U.S. Cl. ..... 224/178; 24/265 B; 24/265 WS; 224/164; 224/168; 368/282

(58) Field of Search ..... 224/178, 164, 224/168, 171, 175, 176, 177; 368/281, 282; 24/265 WS, 265 B

(56) References Cited

U.S. PATENT DOCUMENTS

D. 344,038 2/1994 Phillips et al. .
D. 390,492 2/1998 Riley .
2,625,192 * 1/1953 Kinskie ..... 224/902 X
4,213,548 * 7/1980 Wood ..... 224/168
5,425,007 * 6/1995 Walter et al. ..... 224/176
5,838,642 * 11/1998 Tully ..... 224/171

FOREIGN PATENT DOCUMENTS

466443 * 7/1950 (CA) ..... 224/168
6915 * 3/1912 (GB) ..... 224/168

* cited by examiner

*Primary Examiner*—Gregory M. Vidovich
*Assistant Examiner*—Maerena W. Brevard
(74) *Attorney, Agent, or Firm*—Frishauf, Holtz, Goodman, Langer & Chick, P.C.

(57) ABSTRACT

A band which can be changed easily and speedily comprises a first band member to which a case is attached detachably, a second band member disposed to overlap on the first band member, and a loop into which the second band member and a right end portion of the first band member are inserted to overlap each other to secure the right end portion of the first band member to the second band member detachably. By pulling out the right end portion of the first band member from the loop, the right end portion of the first band member can be detached from the second band member. By inserting the right end portion of the first band member and the second band member into the loop to overlap each other, the right end portion of the first band member can be attached to the second band member.

4 Claims, 21 Drawing Sheets

BAND

BACKGROUND OF THE INVENTION

1. Field of the Invention

The present invention relates to a band which is useful for applications such as a watch band or the like.

2. Description of the Related Art

Conventionally, a watch band which is attached to a case complete and has a structure as follows has been known.

Such a band comprises a band body made of elastic rubber, a female buckle attached on one end portion of the band body, and a male buckle attached on the other end portion thereof detachably. In a state of the male buckle detached from the band body, by inserting the band body into each insertion hole of two band attachment portions which are provided on a case complete, the case complete can be attached to the band body. Thereafter, the male buckle is attached to the other end portion of the band body.

In such a case, the female buckle comprises an attachment hole into which the one end portion of the band body is inserted to be turned back. By securing the turned and overlapped portions to each other, the female buckle is attached to the one end portion of the band body.

The male buckle has two attachment holes into which the other end portion of the band body is inserted. By inserting the other end portion of the band body into one attachment hole and inserting a top end portion thereof into the other attachment hole to be turned back, the male buckle can be attached to the other end portion of the band body detachably.

A watch glass is attached on an upper surface of the case complete, a case back is attached on a lower surface thereof, and a watch module is contained in an inside thereof.

However, in such a watch band, only when the male buckle is detached from the other end portion of the band body, can the case complete be detached from the band body. Further, after the case complete is attached to another band body, it is required to attach the male buckle to an end portion of the another band body. As the result, it is complicated and takes plenty of time to change the band body. Therefore, there is a problem that it is not possible to change the band body easily and speedily.

SUMMARY OF THE INVENTION

The present invention has been developed in view of the these problems.

An object of the present invention is to provide a band which can be changed with another one easily and speedily.

Another object of the invention is to provide a band which comprises two band members of which elastic states are adjustable certainly even if the one of which is made of an elastic member and the other of which is made of an inelastic member.

In order to accomplish the above objects, in accordance with the invention, a band has such a structure as follows. To structural members or the like, the same reference numerals and the like as those for the structural members which will be explained in each embodiment described later in the drawings are attached with parentheses.

In accordance with one aspect of the invention, as shown in FIGS. 1 to 23, the band comprises: a first band member (first band member 10); a second band member (second band member 11) disposed to overlap on the first band member; and a connecting member (loop 12, first fastening member 13, or holding member 27) which is attached to at least one of the first and second band members to connect the first and second band members with each other.

According to the band, by detaching a connecting of the first band member and the second band member by the connecting member to release the first band member and the second band member, which are overlapped with each other, it is possible to easily detach a wrist member attached to the first band member, which is a wristwatch or the like, for example. It is also possible to attach the wrist member, e.g., a wristwatch or the like, to the first band member easily. As the result, it is possible to change the band easily and speedily.

To the connecting member, various types of member can be applied, for example, as shown in FIGS. 1 to 6, 8, 9, and 13, the connecting member is a loop (12, 17, or 20) which is attached to a side of the second band member to be movable in a longitudinal direction thereof. As shown in FIGS. 9 to 14, the connecting member can be a holding member (27 or 30) which is disposed on the side of the second band member. As shown in FIGS. 1 to 6 and 8, the connecting members can be fastening member (13, 15, or 25) which is disposed on surfaces of the first band member and the second band member, which face to each other, to fasten the first band member and the second band member to each other detachably.

The first band member, for example, is made of elastic material, while the second band member is made of an inelastic material, as shown in FIGS. 1 to 6, 8, 9, and 13.

To the first band member, for example, a wrist member (4) is attached detachably, as shown in FIGS. 1 to 6, 8, 9, 13, 15, 16, 20, and 22. The wrist member, for example, is a wristwatch (4) and the wristwatch is attached to the first band member through band attachment portions (5 and 5) of the wristwatch detachably.

BRIEF DESCRIPTION OF THE DRAWINGS

FIGS. 14A and 14B show the holding member shown in FIG. 13; wherein FIG. 14A is a perspective view showing a development state the holding member; and FIG. 14B is a perspective view showing a bent state of the holding member in a loop shape;

FIG. 23A is an enlarged cross-sectional view of the holding portion on the right side in FIG. 22; and FIG. 23B is an enlarged cross-sectional view taken along the line C—C of FIG. 23A.

PREFERRED EMBODIMENT OF THE INVENTION

First Embodiment

The first embodiment, in which the present invention is applied for a watch band will be explained in detail with reference to FIG. 1.

Figure 1:
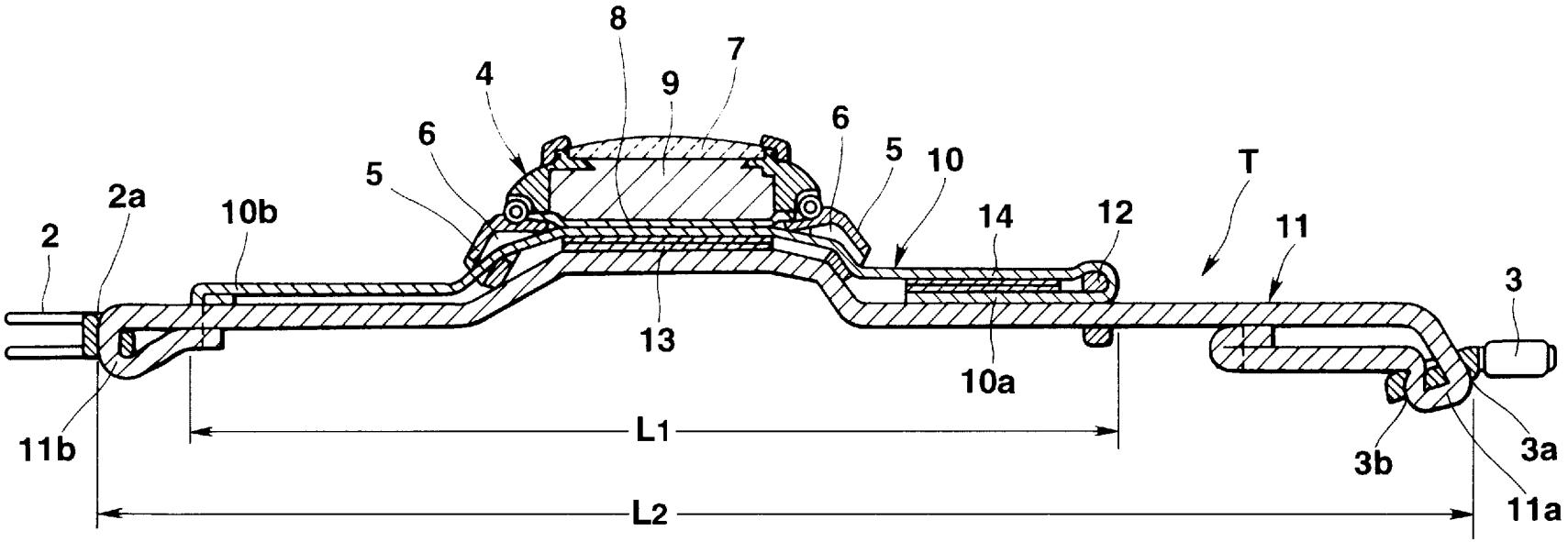
FIG. 1 is a cross-sectional view showing the watch band according to a first embodiment of the invention.

A watch band T comprises a first band member 10 to which a case complete 4 is attached, a second band member 11 to which the first band member 10 is attached to overlap each other, and a loop 12 which is a connecting member which enables an attachment of one end portion which is a right end portion 10*a* in the Figure, of the first band member 10 to the second band member 11 detachably, as shown in FIG. 1.

The first band member 10 is made of inelastic cloth. The case complete 4 is attached to the first band member 10 by inserting the first band member 10 into each insertion hole 6 of two band attachment portions 5 which are provided on the case complete 4. A length of the first band member 10 is shorter than that of the second band member 11. Both of the one end portion of the first band member 10, which is the right end portion 10*a* in the Figure, and the second band member 11 are overlapped with each other to be inserted into the loop 12 together, while the other end portion which is a left end portion 10*b* in the Figure is secured to the second band member 11 by sewing together or the like.

The second band member 11 is made of elastic rubber like the conventional example. A male buckle 3 is detachably attached to one end portion of the second band member 11, which is a right end portion 11*a* in the Figure, while a female buckle 2 is attached to the other end portion of the second band member 11, which is a left end portion 11*b* in the Figure.

The loop 12 is an elliptic shaped ring. By inserting both of the right end portion 10*a* of the first band member 10 and a right side of the second band member 11 to which the male buckle 3 is attached detachably, into the loop 12 to overlap each other, it is possible to enable attachment of the right end portion 10*a* of the first band member 10 to the second band member 11 detachably.

At positions for the case complete 4 to be set thereon, on the surfaces of the first band member 10 and the second band member 11, which face each other, a first fastening member 13 which comprises a pair of connecting members is attached. The pair of connecting members are for connecting to detachably fasten the first band member 10 and the second band member 11 by pressing the pair of connecting members to each other. The connecting members are a pair of sheets having resilient hook and loop fasteners (sold under the registered trademark "Magic Tape" or "VELCRO") which have surfaces facing to each other to fasten detachably by pressing the facing surfaces to each other.

The right end portion 10*a* of the first band member 10, which is inserted into the loop 12 is turned inside to hold the loop 12. The turned right end portion 10*a* is at a position between the first band member 10 and the second band member 11 to overlap. At the facing surfaces of the first band member 10, which are turned back to overlap to each other, a second fastening member 14 which comprises a pair of subsidiary fastening members is attached. The pair of subsidiary fastening members are for detachably fastening both of the overlapped portions of the first band member 10 by pressing the pair of subsidiary fastening members to each other. The pair of subsidiary fastening members are also the pair of sheet fasteners which have surfaces facing to each other to fasten detachably by pressing the facing surfaces to each other, like the first fastening member 13.

Next, away of changing the watchband T will be explained. In order to detach the watch band T from the case complete 4, the overlapped portions of the right end portion 10*a* of the first band member 10 are pulled apart from each other to release the fastening by the second fastening member 14. Among the overlapped portions of the first band member 10 which are released the fastening, a portion of the first band member 10, which is inserted into and hold the loop 12 is pulled out of the loop 12. As the result, the right end portion 10*a* of the first band member 10 comes to be free by detaching from the second band member 11.

Thereafter, when the fastening state of the positions for the case complete 4 to be set thereon, of the first band member 10 and the second band member 11, which face to each other, by the first fastening member 13 is released, the first band member 10 and the second band member 11 are pulled apart from each other. As the result, the case complete 4 is released from the fastening to each band member 10 and 11. In this state, the right end portion 10*a* of the first band member 10 is pulled out from each insertion hole 6 of the two band attachment portions 5 provided on the case complete 4.

Therefore, it is possible to detach the case complete 4 from the first band member 10 easily.

On the contrary, in order to attach the case complete 4 to the watch band T, the right end portion 10*a* of the first band member 10 is inserted into each insertion hole 6 of the two band attachment portions 5 of the case complete 4 one by one. The inserted right end portion 10*a* of the first band member 10 is turned back at the loop 12 to be inserted into the loop 12 to hold the loop 12. The turned portion is overlapped between the first band member 10 and the second band member 11 to fasten the overlapped portions each other by the second fastening member 14. The portions which correspond to the case complete 4, of the first band member 10 and the second band member 11, are fastened each other by the first fastening member 13. Then, it is possible to attach the case complete 4 to the watch band T easily.

As described above, according to the watch band T, by pulling out the right end portion 10*a* of the first band member 10 from the loop 12, the right end portion 10*a* of the first band member 10 can be detached from the second band member 11. As the result, it is possible to detach the case complete 4 from the first band member 10 without detaching the male buckle 3 like the conventional watch band. While, by inserting the right end portion 10*a* of the first band member 10 into the loop 12 to be turned back at the loop 12 to hold the loop 12, it is possible to attach the right end portion 10*a* of the first band member 10 to the second band member 11 easily. Therefore, it is possible to change the watch band T for the case complete 4 easily and quickly.

In this case, because the positions for the case complete 4 to be set thereon, on the surfaces of the first band member 10 and the second band member 11, which face to each other, can be fastened to each other by the pair of connecting members of the first fastening member 13, it is possible to fasten the case complete 4 to the first band member 10 so as not to slip out of place.

The right end portion 10*a* of the first band member 10 is inserted into the loop 12 to be turned back between the first band member 10 and the second band member 11 to hold the loop 12. By fastening the faced surfaces of the turned back and overlapped portions by the second fastening member 14 to each other, it is possible to attach the right end portion 10*a* of the first band member 10 to the second band member 11 by the second fastening member 14 certainly and firmly. Therefore, it is possible to attach the case complete 4 to the first band member 10 certainly.

Further, because the second band member 11 is elastic by weaving the rubber and both of the second band member 11 and the right end portion 10*a* of the first band member 10 are overlapped each other to be inserted into the loop 12 together, the second band member 11 can be elastic through the loop 12 even though the first band member 10 is made of inelastic cloth. Therefore, it is possible to attach the watch band T as a whole to a wrist or the like to fit well.

Second Embodiment

Next, the second embodiment, in which the present invention is applied for a watch band will be explained with reference to FIG. 2. To structural members or the like corresponding to those of the first embodiment shown in FIG. 1, the same reference numerals are attached, and the detailed explanation for them is omitted.

In a watch band T, both end portions 10*a* and 10*b* of the first band member 10 are attached to the second band member 11 by the loops 12.

Figure 2:
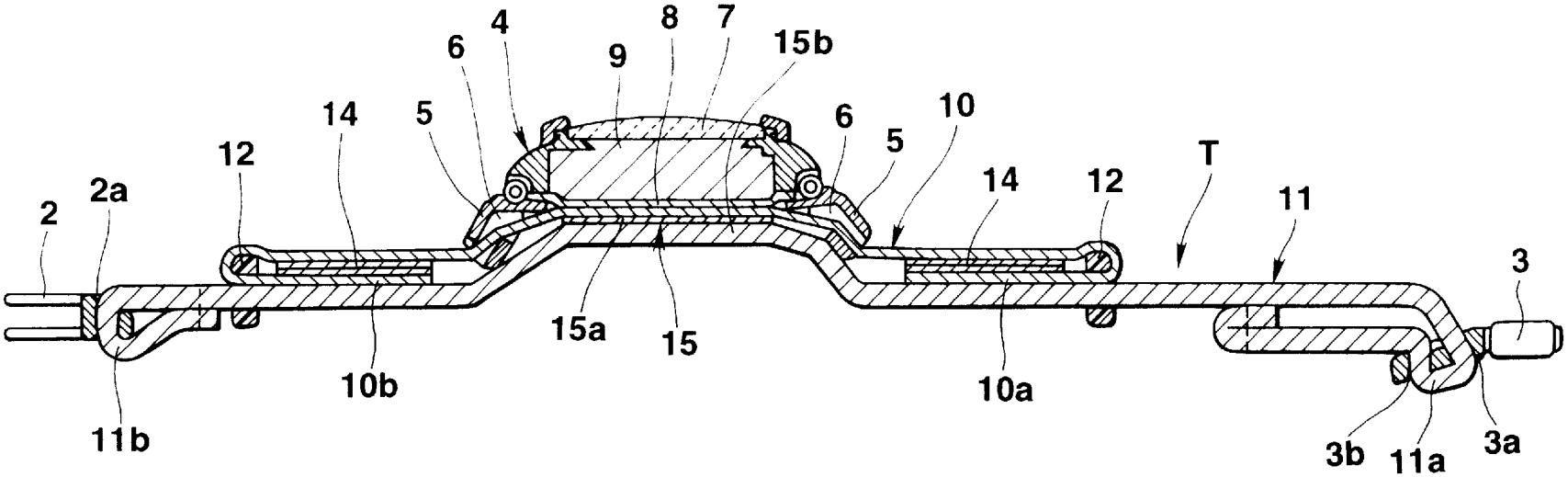
FIG. 2 is a cross-sectional view showing the watch band according to a second embodiment of the invention.

Each loop 12 is inserted to be disposed on one end portion side which is a right end portion 11*a* side in FIG. 2 and the other end portion side which is a left end portion 11*b* side in FIG. 2, of the second band member 11. The one end portion which is the right end portion 10*a* in FIG. 2, of the first band member 10 to which the case complete 4 is attached, is turned back to hold the right side loop 12 and is at a position to overlap between the first band member 10 and the second band member 11, like the first embodiment. The other end portion of the first band member 10, which is the left end portion 10*b* in FIG. 2, is turned back to hold the loop 12 on the left side and is at a position to overlap between the first band member 10 and the second band member 11.

In this case, on the facing surfaces of the turned back and overlapped portions on the both sides of the first band member 10, the second fastening member 14 for fastening the overlapped portions of the first band member 10 to each other by pressing the facing surfaces to each other detachably are attached.

At positions for the case complete 4 to be set thereon, on the surfaces of the first band member 10 and the second band member 11, which face to each other, a first fastening member 15 for fastening the first band member 10 and the second band member 11 by pressing the facing surfaces to each other detachably is attached. The first fastening member 15 comprises a hook fastener 15*a* on the first band member 10 between the positions for the case complete 4 to be set thereon, on the surfaces of the first band member 10 and the second band member 11, which face to each other, and a pile cloth 15*b* on the almost all area of a side of the facing surface of the second band member 11, which faces to the hook fastener 15*a*. By pressing the hook fastener 15*a* on the first band member 10 against the pile cloth 15*b* on the second band member 11 detachably, it is possible to fasten the first band member 10 and the second band member 11 to each other.

According to the watch band T, when one of end portion between both right and left end portions 10*a* and 10*b* of the first band member 10, for example, the right end portion 10*a* is pulled out of the loop 12, it is possible to detach the right end portion 10*a* of the first band member 10 from the second band member 11, like the first embodiment. As the result, it is possible to detach the case complete 4 from the first band member 10 easily. When the case complete 4 is attached to the watch band T, by inserting one of end portion of the first band member 10, which is detached from the second band member 11, for example, the right end portion 10*a* into the loop 12 to be turned back at the loop 12, it is possible to attach the right end portion 10*a* of the first band member 10 to the second band member 11 easily. Therefore, it is possible to change the watch band T easily and speedily.

Because both right and left end portions 10*a* and 10*b* of the first band member 10 are inserted into each loop 12 to be turned back to hold the loop 12, and the turned and overlapped portions are fastened by each second fastening member 14 to each other, it is possible to attach both right and left end portions 10*a* and 10*b* of the first band member 10 to the second band member 11 by the second fastening members 14 certainly and firmly. Therefore, it is possible to attach the case complete 4 to the first band member 10 certainly. Because each of the both right and left end portions 10*a* and 10*b* of the first band member 10 and the second band member 11 are overlapped to each other to be inserted into each loop 12 to be attached to the second band member 11, the second band member 11 can be elastic more than that in the first embodiment. Therefore, it is possible to attach the band watch T to a wrist to fit better.

In the watch band T, both right and left end portions 10*a* and 10*b* of the first band member 10 are attached to the second band member 11 by each loop 12 detachably. By pulling out the both right and left end portions 10*a* and 10*b* of the first band member 10 from each loop 12, it is possible to detach the first band member 10 from the second band member 11 completely. Therefore, because it is possible to change the first band member 10 and second band member 11 to another, it is possible to make various combinations of them as the watch band T.

Because the first fastening member 15 which fastens the positions for the case complete 4 to be set thereon, on the surfaces of the first band member 10 and the second band member 11 comprises the hook fastener 15*a* provided on the facing surface of the first band member 10 and the pile cloth 15*b* provided on the almost all area of facing surface side of the second band member 11, which faces to the hook fastener 15*a*, it is possible to adjust a pressing position of the hook fastener 15*a* of the first band member 10 against the pile cloth 15*b* of the second band member 11. Therefore, it is possible to adjust an attachment position of the case complete 4 on the first band member 10 and to attach the case complete 4 to the most suitable position.

Third Embodiment

Figure 3:
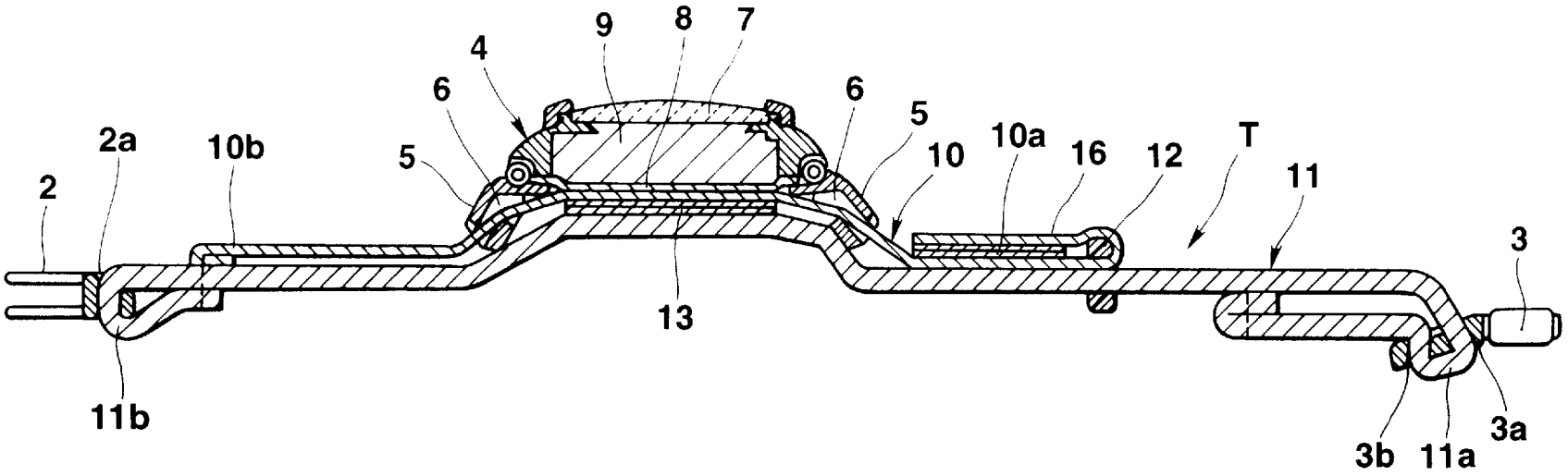
FIG. 3 is a cross-sectional view showing the watch band according to a third embodiment of the invention.

The third embodiment, in which the present invention is applied for a watch band will be explained with reference to FIG. 3. To structural members or the like corresponding to those of the first embodiment shown in FIG. 1, the same reference numerals are attached, and the detailed explanation for them is omitted.

A watch band T has the same structure as the first embodiment except a turning back direction of one end portion of the first band member 10, for example, the right end portion 10*a* is different from that of the first embodiment.

The right end portion 10*a* of the first band member 10 and the right end portion 11*a* side of the second band member 11 are inserted to overlap into the loop 12 which is inserted into the right end portion 11*a* side of the second band member 11 and the right end portion 10*a* is turned back to upper side to hold the loop 12 to be at a position on the first band member 10 to overlap. In this case, on facing surfaces of the first band member 10, which are turned back to overlap portions to each other, a second fastening member 16 for fastening both overlapped portions of the first band member 10 by pressing to each other detachably is attached. The second fastening member 16 is the pair of sheet fasteners which have surfaces facing to each other to fasten detachably by pressing the facing surfaces to each other, like the first embodiment.

The watch band T above-described has the same function as that of the first embodiment. Further, particularly because the right end portion 10*a* of the first band member 10 is turned back after inserted into the loop 12, it is possible to enable the attachment of the right end portion 10*a* of the first band member 10 more easily than that in the first embodiment. When the fastening by the second fastening member 16 is released by pulling apart the turned and overlapped portions from each other, it is only required to pull up an upper side portion of the overlapped portions. Therefore, it is possible to pull apart those from each other more easily than that in the first embodiment, and to easily detach the first band member 10 from the second band member 11.

Fourth Embodiment

Figure 4:
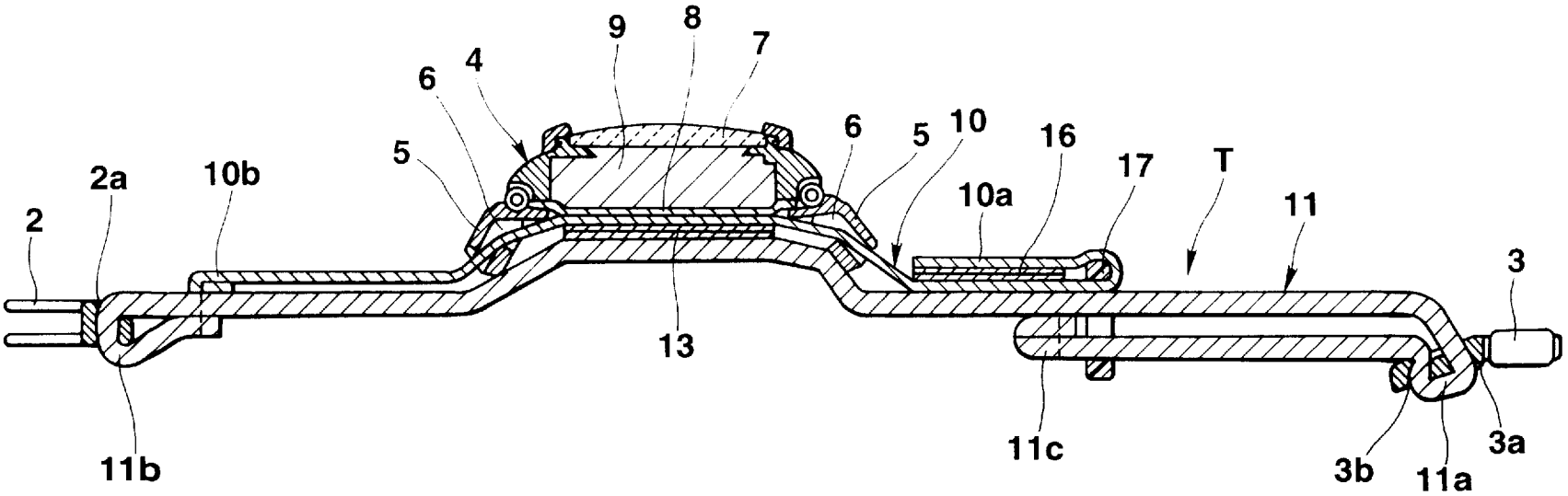
FIG. 4 is a cross-sectional view showing the watch band according to a fourth embodiment of the invention.

The fourth embodiment, in which the present invention is applied for a watch band will be explained with reference to FIG. 4. To structural members or the like corresponding to those of the third embodiment shown in FIG. 3, the same reference numerals are attached, and the detailed explanation for them is omitted.

A watch band T has the same structure as the third embodiment except a shape of a loop 17 is different from that of the loop in the third embodiment.

The first band member 10 and the second band member 11 are overlapped to each other to be inserted into an inside of the loop 17 in the watch band T. A turned top end portion 11*c* of the one end portion of the second band member 11, which is the right end portion 11*a* in FIG. 4, to which the male buckle 3 is attached is further overlapped the first band member 10 and the second band member 11 to be inserted together into the loop 17.

The watch band T above-described has the same function as that of the third embodiment. Further, particularly, because to the loop 17 into which the first band member 10 and the second band member 11 are inserted to overlap to each other, the turned back top end portion 11*c* of the right end portion 11*a* of the second band member 11 is further overlapped them to be inserted together, it is possible to secure the turned top end portion 11*c* of the right end portion 11*a* of the second band member 11 so as not to dangle. Therefore, it is possible to manufacture the suitable watch band T to use.

Fifth Embodiment

The fifth embodiment, in which the present invention is applied for a watch band will be explained with reference to FIG. 5. To structural members or the like corresponding to those of the third embodiment shown in FIG. 3, the same reference numerals are attached, and the detailed explanation for them is omitted.

A watch band T has the same structure as the third embodiment except that another loop 18 in addition to the loop 12 is inserted into the second band member 11.

Figure 5:
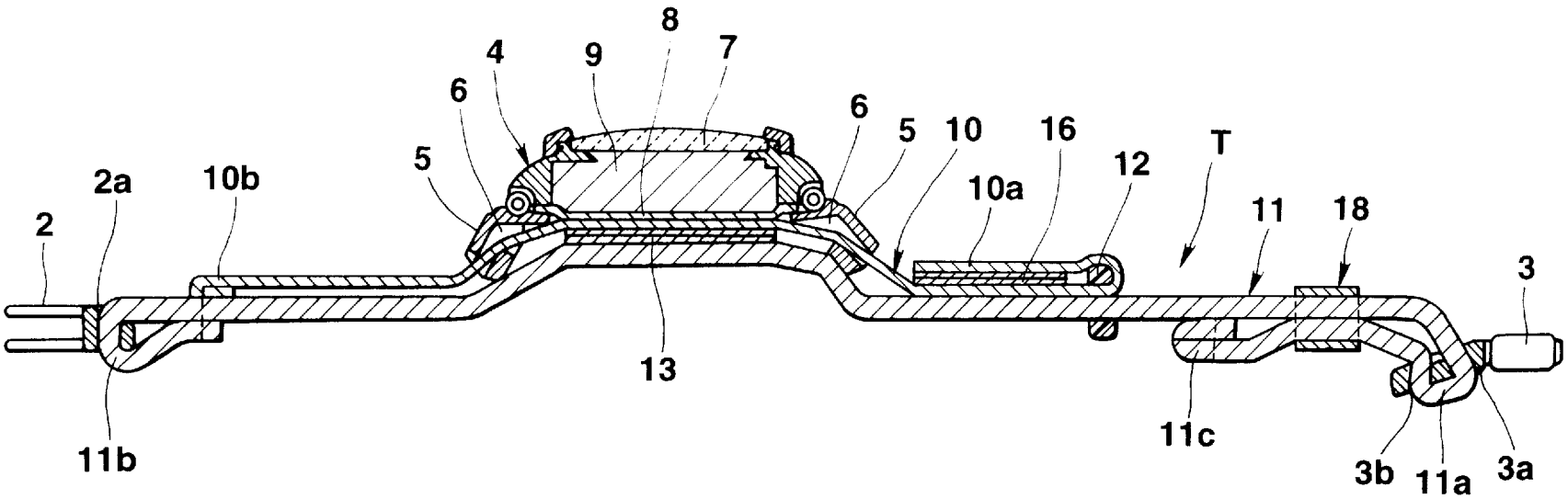
FIG. 5 is a cross-sectional view showing the watch band according to a fifth embodiment of the invention.

In the watch band T, the top end portion 11*c* of the second band member 11 is secured by the another loop 18 by inserting the loop 12 into one end portion side which is a right end portion 11*a* side in FIG. 5, of the second band member 11, inserting the another loop 18 into the second band member 11 to a further right side of the loop 12, attaching the right end portion 10*a* of the first band member 10 to the second band member 11 by the loop 12, and inserting the turned back top end portion 11*c* of the right end portion 11*a* of the second band member 11, to which the male buckle 3 is attached, into the another loop 18 on the right side of the loop 12.

The watch band T above-described has the same function as that of the third embodiment. Further, particularly, because the turned top end portion 11*c* of the right end portion 11*a* of the second band member 11 can be secured by the another loop 18, it is possible to secure the turned top end portion 11*c* of the right end portion 11*a* of the second band member 11 so as not to dangle, like the fourth embodiment. Therefore, it is possible to manufacture the suitable watch band T to use.

In the fourth and fifth embodiments described above, the right end portion 10*a* of the first band member 10 is turned back after the one is inserted into the loops 17 and 12. However, it is not limited to those. For example, after the right end portion 10*a* of the first band member 10 is turned back on upper side of the loops 17 and 12, the right end portion 10*a* may be inserted into the loops 17 and 12, like the first embodiment. In this case, it is preferable to dispose the second fastening member 14 on the facing surfaces of the turned back and overlapped portions of the right end portion 10*a* of the first band member 10, like the first embodiment.

Sixth Embodiment

The sixth embodiment, in which the present invention is applied for a watch band will be explained with reference to FIGS. 6 and 7. To structural members or the like corresponding to those of the first embodiment shown in FIG. 1, the same reference numerals are attached, and the detailed explanation for them is omitted.

A watch band T has the same structure as the first embodiment except a shape of a loop 20 is different from that of the loop in the first embodiment.

Figure 6:
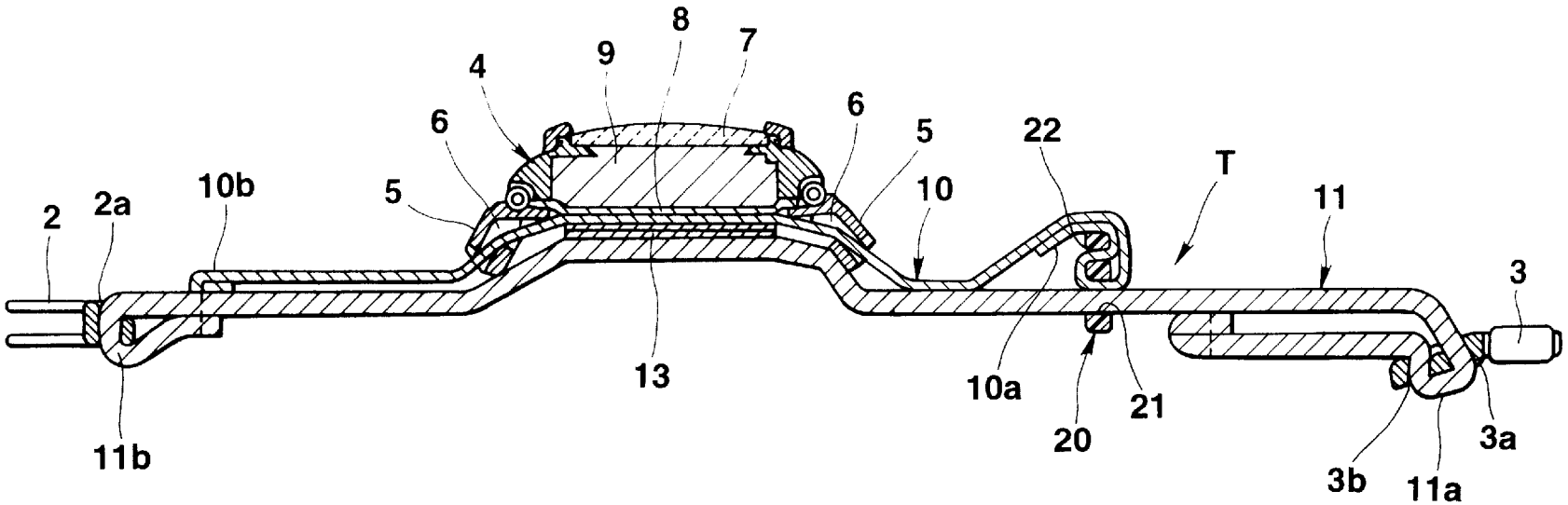
FIG. 6 is a cross-sectional view showing the watch band according to a sixth embodiment of the invention.
Figure 7:
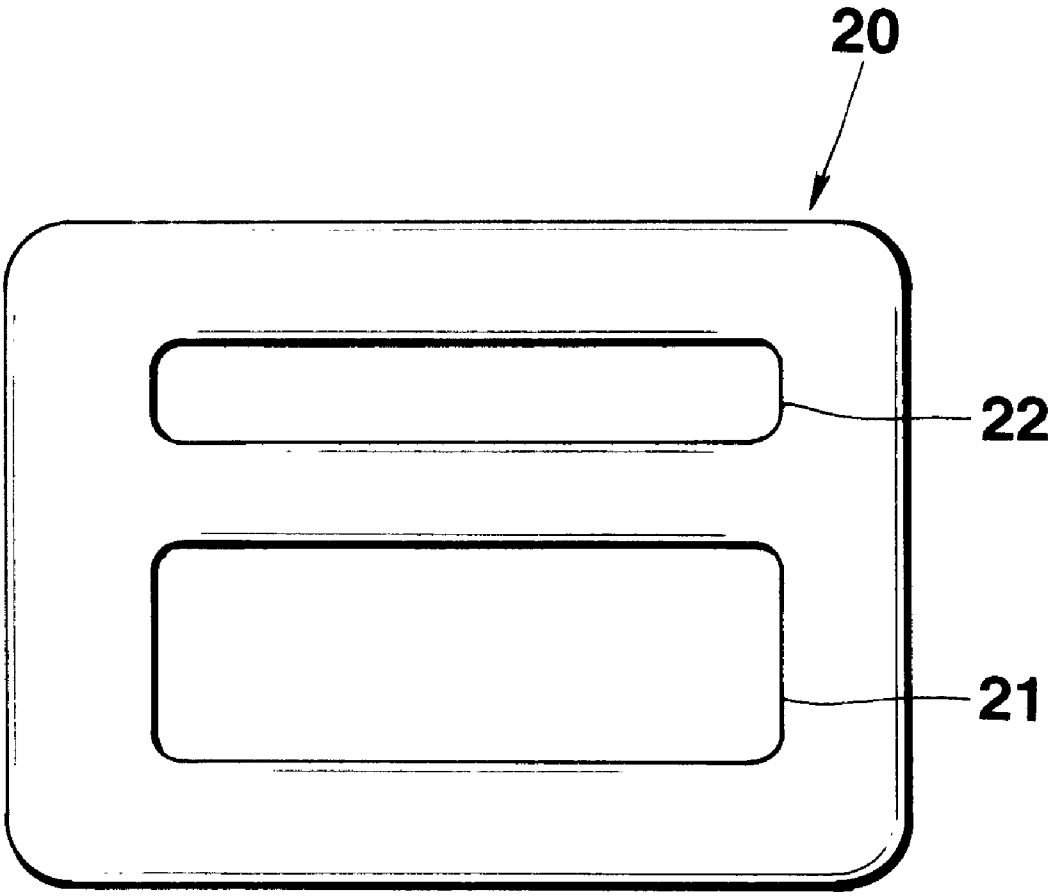
FIG. 7 is an enlarged front view of the loop shown in FIG. 6.

The loop 20 of the watch band T is for attaching the right end portion 10*a* of the first band member 10 to the right side of the second band member 11 detachably, as shown in FIG. 6. A first insertion hole 21 and a second insertion hole 22 are formed in a shape like a figure of "8", in the loop 20, as illustrated in FIG. 7. The first insertion hole 21 is formed to have enough size for that both of the first band member 10 and the second band member 11 are inserted thereinto to overlap. The second insertion band 22 is for further the right end portion 10*a* of the first band member 10 is inserted thereinto, which is inserted into the first insertion hole 21, and formed smaller than the first insertion hole 21 in size.

In the watch band T, by inserting the right end portion 10*a* of the first band member 10 to be turned back and overlap the second band member 11 to each other into the first insertion hole 21 of the loop 20 to which the second band member 11 is inserted, inserting the inserted right end portion 10*a* further to be turned back into the second insertion hole 22, and positioning the inserted right end portion 10*a* further to be turned back between an upper side of the loop 20 and the first band member 10, it is possible to attach the right end portion 10*a* of the first band member 10 to the second band member 11. Therefore, because it is possible to attach the right end portion 10*a* of the first band member 10 to the second band member 11 not to use the second fastening member 14 like in the first embodiment, it is possible to decrease a number of member of the watch band T.

According to the third to sixth embodiments above-described, the other end portion 10*b* of the first band member 10, which is each left end portion in FIGS. 3 to 6, is secured to the second band member 11. However, it is not limited to those. For example, the left end portion 10*b* of the first band member 10 can be attached to the second band member 11 detachably by attaching the loop 12 or 20 which is corresponded to each embodiment to the left side of the second band member 11. As the result, like the second embodiment, by pulling out the both right and left end portions 10*a* and 10*b* of the first band member 10 from each loop 12 and 20, it is possible to detach the first band member 10 from the second band member 11 completely. Therefore, because it is possible to change the first band member 10 and second band member 11 to another one, it is possible to make various combinations of them as the watch band T.

According to the third to sixth embodiments, at the positions for the case complete 4 to be set thereon, on the surfaces of the first band member 10 and the second band member 11, which face to each other, the first fastening member 14 for fastening them to each other detachably is attached. However it is not limited to those. The first fastening member 15 which comprises the hook fastener 15*a* provided on the faced surface of the first band member 10 and the pile cloth 15*b* on the almost all area of the facing surface side of the second band member 11, which faces to the hook fastener 15*a*, can be used like the second embodiment. In this case, it is possible to adjust the pressing position of the hook fastener 15*a* on the first band member 10 against the pile cloth 15*b* on the second band member 11, like the second embodiment. Therefore, it is possible to adjust the attachment position of the case complete 4 on the first band member 10 and to attach the case complete 4 to the most suitable position.

Seventh Embodiment

Figure 8:
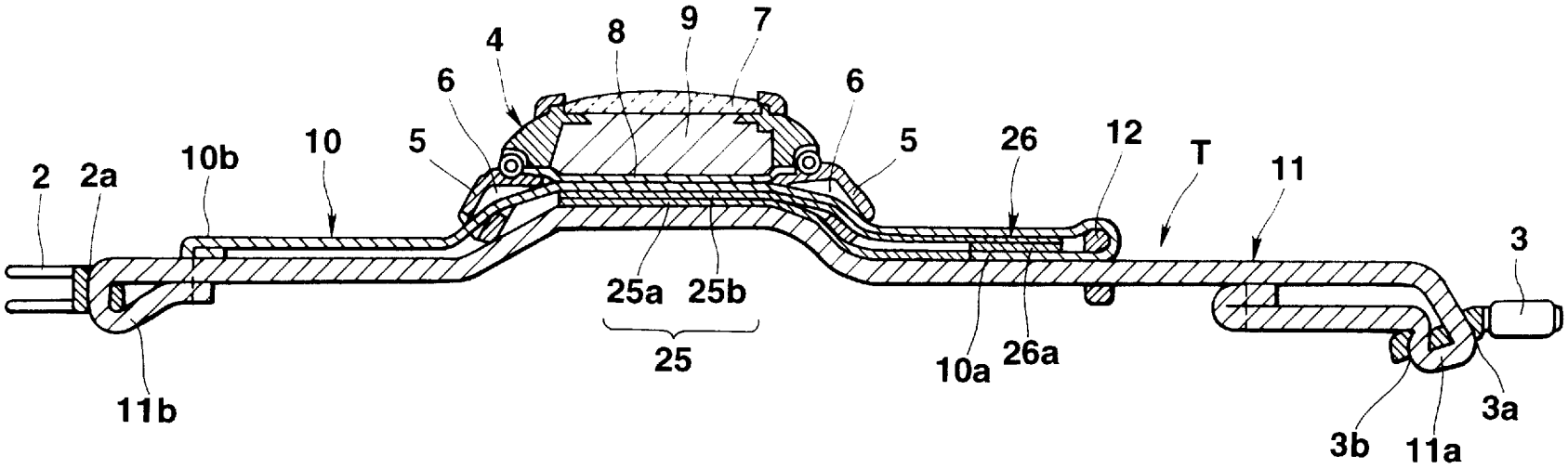
FIG. 8 is a cross-sectional view showing the watch band according to a seventh embodiment of the invention.

The seventh embodiment, in which the present invention is applied for a watch band will be explained with reference to FIG. 8. To structural members or the like corresponding to those of the first embodiment shown in FIG. 1, the same reference numerals are attached, and the detailed explanation for them is omitted.

A watch band T has the same structure as the first embodiment except that a first fastening member 25 which comprises a pair of connecting members for fastening the first band member 10 and second band member 11 detachably by pressing to each other and a second fastening member 26 which comprises a pair of subsidiary fastening members for detachably fastening the faced surfaces to each other, which are turned back and overlapped portions of the right end portion 10*a* of the first band member 10 are different from that in the first embodiment. The connecting members of the watch band T comprises a pair of sheet fasteners 25*a* and 25*b*, like the first embodiment, and are disposed on the faced surfaces of the first band member 10 and the second band member 11 over from the positions for the case complete 4 to be set thereon to a vicinity of the loop 12 on the right side thereof.

The sheet fastener 25*a* is disposed on the first band member 10 over from the position for the case complete 4 to be set thereon extending to the vicinity of the loop 12 on the right side thereof, while the sheet fastener 25*b* is disposed on the second band member 11 over from the position for the case complete 4 to be set thereon extending to a position corresponding to a top end of the right end portion 10*a* of the first band member 10, which is turned back at the loop 12.

The pair of subsidiary fastening members are disposed on the faced surfaces of the first band member 10, which are turned back at the loop 12 and overlapped portions. The second fastening member 26 comprises one sheet fastener 26*a* which is disposed on the facing surface of the first band member 10, which is turned back at the loop 12 and overlapped portion and the other sheet fastener which is disposed to face the sheet fastener 26*a*. The right end portion side of the sheet fastener 25*a* of the first fastening member 25, which is disposed on the first band member 10 over from the position for the case complete 4 to be set thereon to the vicinity of the loop 12 is also serves as the other sheet fastener.

According to the watch band T above-described, it has the same function as that of the first embodiment. Further, particularly, because the first fastening member 25 is disposed on over from the positions for the case complete 4 to be set thereon, of the first band member 10 and the second band member 11 to the vicinity of the loop 12 on the right side thereof, it is possible to have a large fastening area of the first fastening member 25, which is pressing to each other. As the result, it is possible to attach the first band member 10 to the second band member 11 more certainly. Because one of the band attachment portion 5 of the case complete 4 is put in the first fastening member 25, it is possible to secure the case complete 4 to a predetermined position of the first band member 10. Because the sheet fastener 25*a* disposed on the side of the first band member 10, of the first fastening member 25 is extended to the vicinity of the loop 12, the sheet fastener 25*a* can be served as the other sheet fastener of the second fastening member 26. Therefore, it is possible to have function of the second fastening member 26 only by the one sheet fastener 26*a*.

Eighth Embodiment

The eighth embodiment, in which the present invention is applied for a watch band will be explained with reference to FIGS. 9 to 11. To structural members or the like corresponding to those of the first embodiment shown in FIG. 1, the same reference numerals are attached, and the detailed explanation for them is omitted.

A watch band T has the same structure as the first embodiment except that the watch band T comprises a holding member 27 as a connecting member for attaching the first band member 10 and the second band member 11 in place of the first fastening member 13 in addition to the loop 12.

Figure 9:
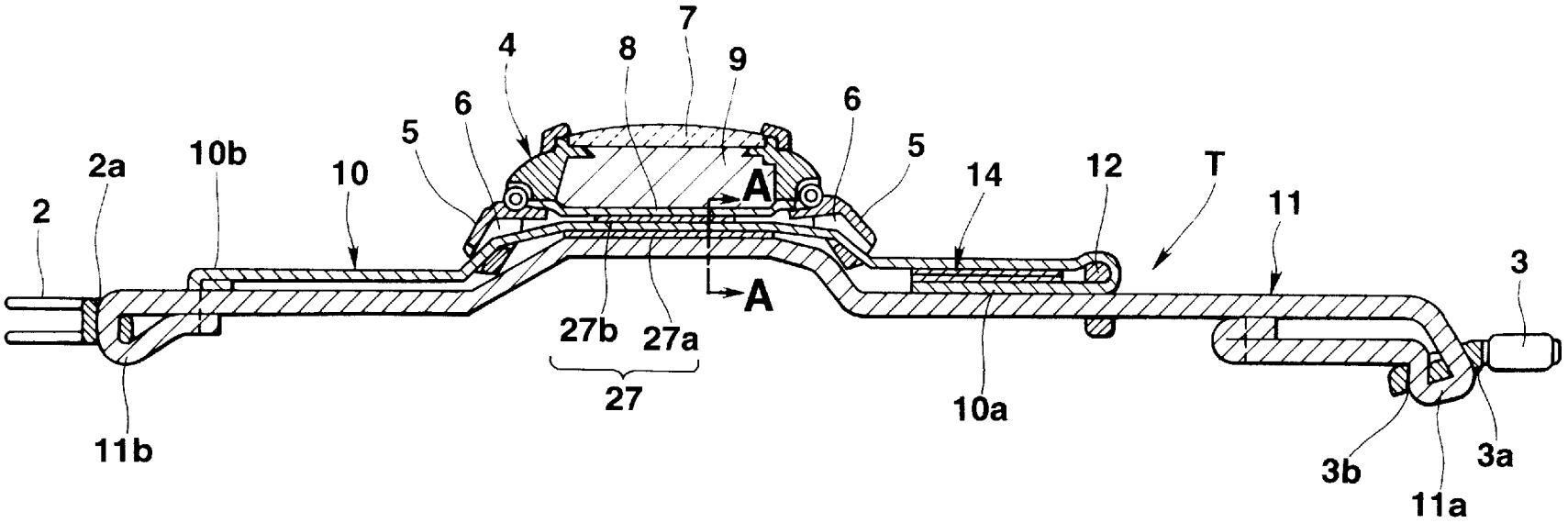
FIG. 9 is a cross-sectional view showing the watch band according to an eighth embodiment of the invention.

The holding member 27 is attached to the surface of the second band member 11 which faces to the position for the case complete 4 to be set thereon, of the first band member 10, as shown in FIG. 9.

Figure 10:
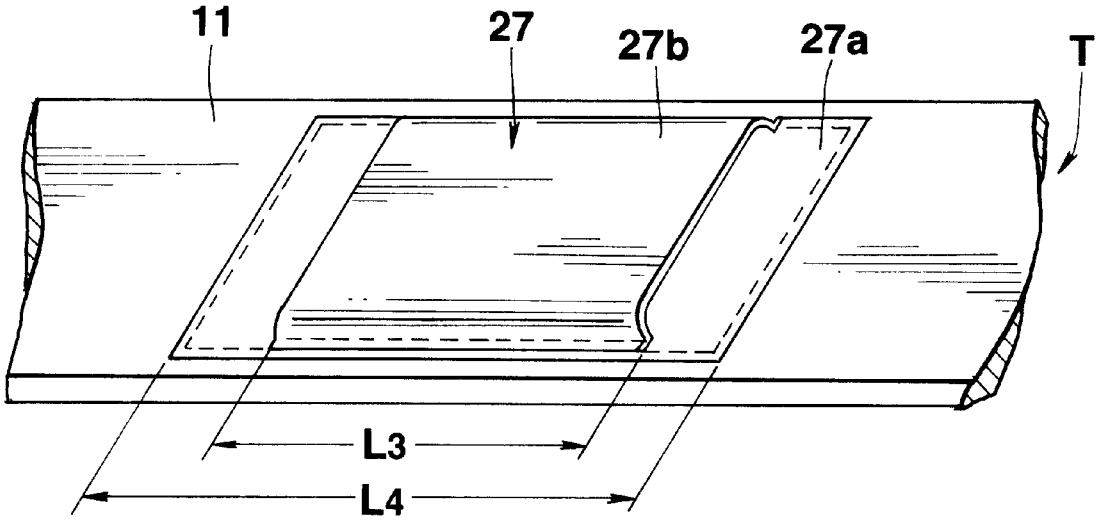
FIG. 10 is an enlarged perspective view of the holding member shown in FIG. 9.
Figure 11:
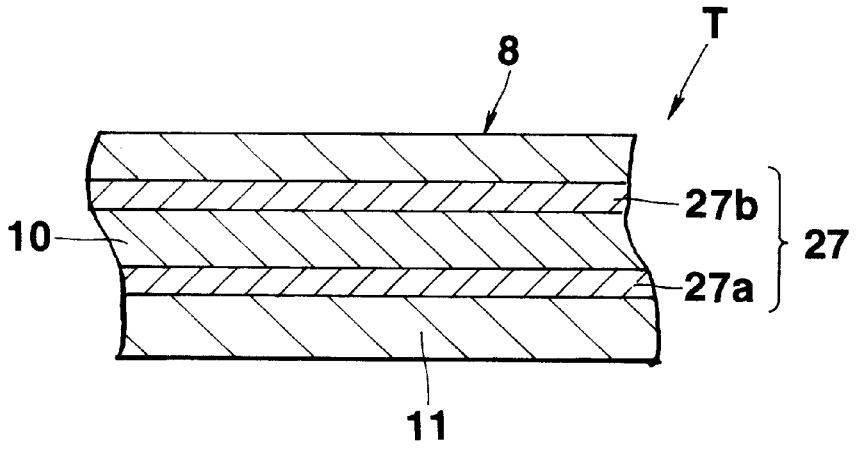
FIG. 11 is an enlarged cross-sectional view taken along the line A—A of FIG. 9.

The holding member 27 comprises a sheet-like member 27*a* which is attached to the facing surface of the second band member 11, which is a upper side in FIG. 10, by sewing or the like and a securing member 27*b* which is attached to an upper surface of the sheet-like member 27*a*, as shown in FIG. 10.

In this case, both sides of the securing member 27*b* along a longitudinal direction of the second band member 11 are attached to the second band member 11 by sewing or the like. Both ends in the longitudinal direction of the securing member 27*b* are opened, so that the first band member 10 will be inserted into an inside thereof, as shown in FIG. 11. A length L3 of the securing member 27*b* in the longitudinal direction of the second band member 11 is shorter than a length L4 of the sheet-like member 27*a*. Therefore, the length L4 between both ends of the sheet-like member 27*a* is longer than the length L3 between both ends of the securing member 27*b* so as to project. The sheet-like member 27*a* and the securing member 27*b* are made of smooth cloth or the like.

A way of detaching the watch band T above-described from the case complete 4, at first, like the first embodiment, the overlapped portions of the right end portion 10*a* of the first band member 10 are pulled apart each other to be released the fastening by the second fastening member 14. Then, by pulling out the released right end portion 10*a* of the first band member 10 from the loop 12, the right end portion 10*a* of the first band member 10 is come to be free by being detached from the second band member 11. Thereafter, the right end portion 10*a* of the first band member 10 with free state is pulled out from the insertion hole 6 of the band attachment portion 5 on the right side of the case complete 4, the inside of the holding member 27, and the insertion hole 6 of the band attachment portion 5 on the left side of the case complete 4, subsequently. As the result, it is possible to detach the attachment of the first band member 10 by the holding member 27 easily. Therefore, it is possible to detach the case complete 4 from the first band member 10 easily.

In order to attach the case complete 4 to the watch band T, the right end portion 10*a* of the first band member 10 is inserted to the insertion hole 6 of the band attachment portion 5 on the left side of the case complete 4. Then, the right end portion 10*a* of the first band member 10 is inserted into the holding member 27 which is attached to the second band member 11. Subsequently, the right end portion 10*a* of the first band member 10 is inserted into the insertion hole 5 on the right side of the case complete 4. As the result, it is possible to attach the first band member 10 to the second band member 11 by the holding member 27 and to attach the case complete 4 to the first band member 10. Thereafter, like the first embodiment, the right end portion 10*a* of the first band member 10 is turned back at the loop 12 to be inserted into the loop 12 to hold the loop 12. Subsequently, the turned portion is overlapped between the first band member 10 and the second band member 11 to fasten the overlapped portion by the second fastening member 14. Therefore, it is possible to attach the case complete 4 to the watch band T easily.

According to the watch band T above-described, by pulling out the right end portion 10*a* of the first band member 10 from the loop 12, it is possible to detach the right end portion 10*a* of the first band member 10 from the second band member 11. By pulling out the right end portion 10*a* of the first band member 10, which is detached from the loop 12, from the insertion holes 6 of each band attachment portion 5 of the case complete 4 and from the holding member 27, it is possible to detach the case complete 4 from the first band member 10 easily. Further, by inserting the right end portion 10*a* of the first band member 10 into the insertion holes 6 of each band attachment portion 5 of the case complete 4 and the inside of the holding member 27 and subsequently turning back at the loop 12 to be inserted into the loop 12 to hold the loop 12, it is possible to attach the right end portion 10*a* of the first band member 10 to the second band member 11. Therefore, it is possible to change the watch band T easily and speedily.

Because the holding member 27 comprises the sheet-like member 27*a* and the securing member 27*b*, which are made of the smooth cloth, it is possible to smoothly insert the right end portion 10*a* of the first band member 10 between the sheet-like member 27*a* and the securing member 27*b* although the second fastening member 14 comprising the pair of the sheet fasteners is disposed on the right end portion 10*a* of the first band member 10. Further, because the length L4 between both ends of the sheet-like member 27*a* is longer than the length L3 between both ends of the securing member 27*b* to project, it is possible to smoothly insert the right end portion 10*a* of the first band member 10 between the sheet-like member 27*a* and the securing member 27*b* to guide the top end of the right end portion 10*a* of the first band member 10 by the projecting portion of the sheet-like member 27*a*.

Figure 12:
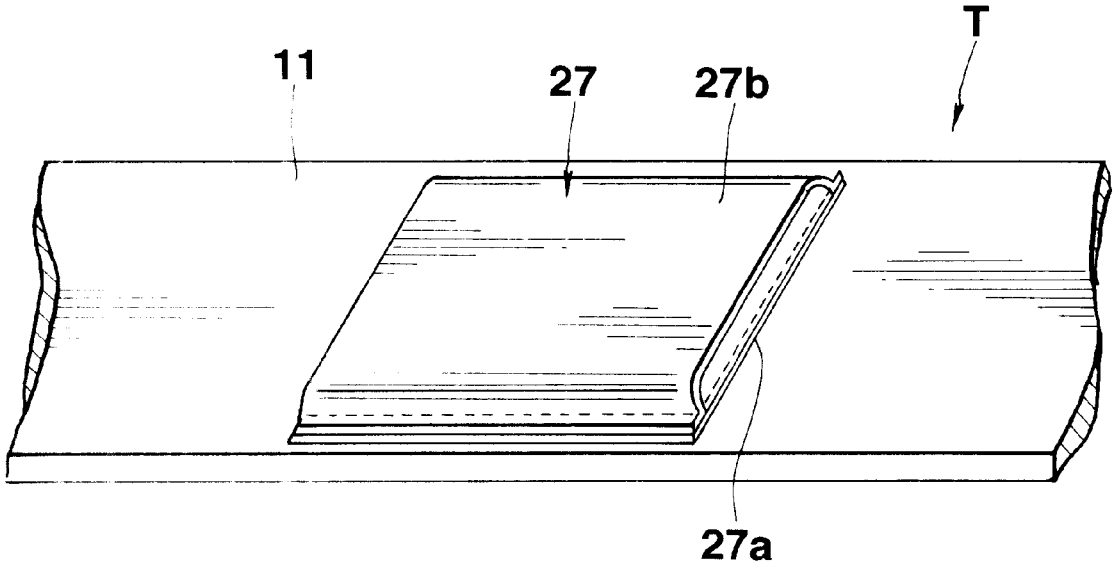
FIG. 12 is a perspective view showing a modified example of the holding member in the eighth embodiment of the invention.

In the eighth embodiment, both end portions of the sheet-like member 27*a* of the holding member 27 are projected to both end portions of the securing member 27*b*. However, it is not limited to this. For example, both end portions of the sheet-like member 27*a* can be at the same position as that of the securing member 27*b* so as not to project, as shown in FIG. 12. It is not always required the sheet-like member 27*a*, that is, only the securing member 27*b* can be attached to the second band member 11 directly.

In the eighth embodiment, the holding member 27 is attached to the second band member 11. However, it is not limited to this. For example, the holding member 27 can be attached to the facing surface of the first band member 10, so that the second band member 11 can be inserted into the inside of the holding member 27.

In the seventh and eighth embodiments, the left end portion 10*b* of the first band member 10 is secured to the second band member 11 by sewing or the like. However, it is not limited to this. For example, both end portions 10*a* and 10*b* of the first band member 10 can be attached to the second band member 11 through each loop 12, like the second embodiment as shown in FIG. 2. As the result, because it is possible to the detach the first band member 10 from the second band member 11 completely, it is possible to change the first band member 10 and the second band member 11 to another one. Therefore, it is possible to make various combinations of them as the watch band T.

Ninth Embodiment

The ninth embodiment, in which the present invention is applied for a watch band will be explained with reference to FIGS. 13 and 14. To structural members or the like corresponding to those of the second embodiment shown in FIG. 2, the same reference numerals are attached, and the detailed explanation for them is omitted.

A watch band T has the same structure as the second embodiment except that the watch band T comprises a holding member 30 comprising a connecting member for attaching the first band member 10 and the second band member 11 to each other in place of the first fastening member 15 in addition to the two loops 12 on both sides. The holding member 30 is attached to the position for the case complete 4 to be set thereon, on the surface of the second-band member 11, which faces to the position therefor of the first band member 10, as shown in FIG. 13. A band-shape member 31 of the holding member 30, of which length L6 is longer than a width L5 of the second band member 11 is disposed in a perpendicular to a longitudinal direction of the second band member 11, as shown in FIG. 14A. An intermediate portion of the band-shape member 31 is secured to the facing surface of the second band member 11, which is an upper side in FIG. 14A by sewing or the like. A fastening portion 32 which comprises a pair of sheet fasteners 32*a* and 32*b* which detachably press to each other is attached to facing surfaces of both end portions of the band-shape member 31, which overlap to face to each other when the band-shape member 31 is bent in a loop shaped, as shown in FIG. 14B.

According to the watch band T, when one of end portion between the right and left end portions 10*a* end 10*b*, of the first band member 10, for example, the right end portion 10*a* is pulled out of the loop 12, it is possible to detach the right end portion 10*a* of the first band member 10 from the second band member 11, like the second embodiment. In this state, by slacking the position for the case complete 4 to be set thereon, of the first band member 10, and by pulling apart the fastening portion 32 of the holding member 30 from each other to release the fastening of the overlapped both end portions of the band-shape member 31, it is possible to enable the attachment of the first band member 10 by the holding member 30 to be released. As the result, it is possible to detach the case complete 4 from the first band member 10 easily.

When the case complete 4 is attached to the watch band T, one of end portion which is detached from the second band member 11, for example, the right end portion 10*a* is inserted into the insertion hole 6 of the band attachment portion 5 in the left side of the case complete 4. Subsequently, in the state of the right end portion 10*a* side of the first band member 10 is overlapped the band-shape member 31 of the holding member 30, the one is wrapped to bend the band-shape member 31 in a loop shaped and the overlapped both end portions of the band-shape member 31 is pressed by the fastening portion 32. By inserting the right end portion 10*a* of the first band member 10 into the insertion hole 6 of the band attachment portion on the right side of the case complete 4, it is possible to attach the first band member 10 to the second band member 11 by the holding member 30 and to attach the case complete 4 to the first band member 10. Thereafter, like the second embodiment, by inserting the right end portion 10*a* of the first band member 10 into the loop 12 to be turned back at the loop 12, it is possible to easily attach the right end portion 10*a* of the first band member 10 to the second band member 11. Therefore, it is possible to change the watch band T easily and speedily.

In the ninth embodiment, the band-shape member 31 of the holding member 30 is attached to the second band member 11 by sewing or the like. However, it is not limited to this. For example, by attaching an elastic cloth to the intermediate portion of the band-shape member 31 by sewing or the like, the second band member 11 can be inserted between the cloth and the band-shape member 31.

Tenth Embodiment

The tenth embodiment, in which the present invention is applied for a watch band will be explained with reference to FIG. 15. To structural members or the like corresponding to those of the first embodiment shown in FIG. 1, the same reference numerals are attached, and the detailed explanation for them is omitted.

Figure 15:
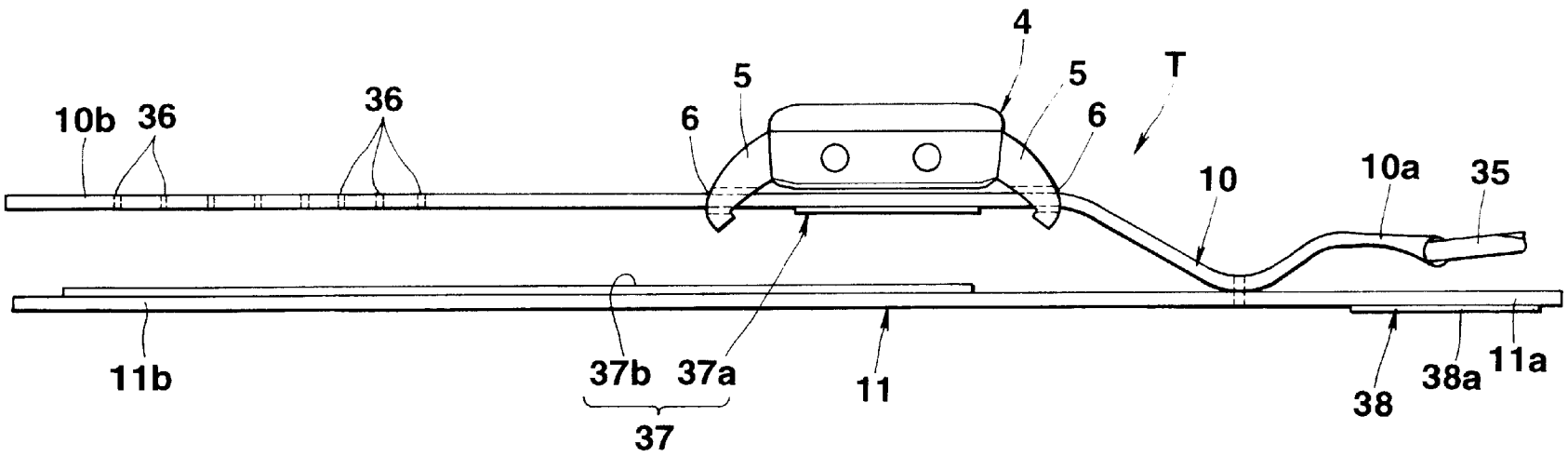
FIG. 15 is a side view showing the watch band according to a tenth embodiment of the invention.

A watch band T comprises: the first band member 10 comprising a buckle 35 on one end portion thereof, which is the right end portion 10*a* in FIG. 15, a plurality of adjusting holes 36 for the buckle 35 on the other end portion side which is the left end portion 10*b* side in FIG. 15 with same spaces along in longitudinal direction; a first fastening member 37 comprising a pair of connecting members for fastening the first band member 10 and the second band member 11 to each other detachably; and a second fastening member 38 comprising a pair of subsidiary fastening members for fastening both end portions 11*a* and 11*b* of the second band member 11 each other detachably. The watch band T has almost the same structure as the first embodiment except the above-described members.

In such the first band member 10, the right end portion 10*a* to which the buckle 35 is attached is secured to the second band member 11 by sewing or the like, while a left end portion 10*b* side in which the adjusting holes 36 are made is inserted into each insertion hole 6 of the two band attachment portions 5 of the case complete 4.

The first fastening member 37 comprises a pair of sheet fasteners 37*a* and 37*b*, wherein one sheet fastener 37*a* is attached to the first band member 10, while the other sheet fastener 37*b* is attached to the second band member 11. The sheet fastener 37*a* is attached to the position for the case complete 4 to be set thereon, of the first band member 10, while the sheet fastener 37*b* is extends from the position for the case complete 4 to be set to the left end portion 11*b* of the second band member 11.

The second fastening member 38 is for detachably fastening the facing surfaces of the overlapped portions of both end portions 11*a* and 11*b* of the second band member 11 to each other when the second band member 11 is bent to attach to the wrist. One sheet fastener 38*a* is attached to a lower surface of the right end portion 11*a* of the second band member 11, while a left end portion side of the sheet fastener 37*b* of the first fastening member 37 serves as the other sheet fastener which is attached to an upper surface of the left end portion 11*b* of the second band member 11.

In such the watch band T, in order to attach the case complete 4 thereto, by inserting the left end portion 10*b* side of the first band member 10 into each insertion hole 6 of the two band attachment portions 5 of the case complete 4 from a right side of the case complete 4 in order, the case complete 4 is faced to the sheet fastener 37*a* on the side of the first band member 10, of the first fastening member 37, as shown in FIG. 15. Then, by pressing the pair of sheet fasteners 37*a* and 37*b* of the first fastening member 37 to each other, it is possible to attach the case complete 4 to the first band member 10 easily. In order to change the watch band T, after pulling apart the pair of sheet fasteners 37*a* and 37*b* of the first fastening member 37 from each other, the left end portion 10*b* side of the first band member 10 is pulled out through each insertion hole 6 of the two band attachment portions 5 of the case complete 4. As the result, it is possible to detach the case complete 4 from the first band member 10. Therefore, it is possible to change the watch band T easily and speedily.

In order to put the watch band T on a wrist, at first, the second band member 11 is wound around the wrist and the one sheet fastener 38*a* of the second fastening member 38 is overlapped the left end portion of the sheet fastener 37*b* of the first fastening member 37 to fasten the second band member 11, so that the second band member 11 is put on the wrist. In this state, the first band member 10 is wound around the second band member 11 and the buckle 35 provided on the right end portion 10*a* of the first band member 10 is engaged with the adjusting hole 36 formed in the left end portion 10*b* side. As the result, it is possible to put the watch band T on the wrist. In this case, the sheet fastener 37*b* of the first fastening member 37 also serves as the other sheet fastener of the second fastening member 38. For the purpose, the sheet fastener 37*b* extends from the position for the case complete 4 to be set to the left end portion 11*b* of the second band member 11. Accordingly, it is possible to adjust a fastening position of the pair of sheet fasteners 38*a* and 37*b* to fit it for the size of wrist. Therefore, it is possible to fit the second band member 11 to the wrist well. In order to detach the watch band T from the wrist, after releasing the engaging the adjusting hole 36 with the buckle 35, by pulling apart the second fastening member 38, it is possible to detach the first and second band members 10 and 11 from the wrist.

Eleventh Embodiment

The eleventh embodiment, in which the present invention is applied for a watch band will be explained with reference to FIGS. 16 to 19. To structural members or the like corresponding to those of the tenth embodiment shown in FIG. 15, the same reference numerals are attached, and the detailed explanation for them is omitted.

A watch band T has almost the same structure as the tenth embodiment except that the watch band T comprises a holding member 40 comprising a connecting member for attaching the first band member 10 to the second band member 11, and a second fastening member 41 attached to the second band member 11.

Figure 16:
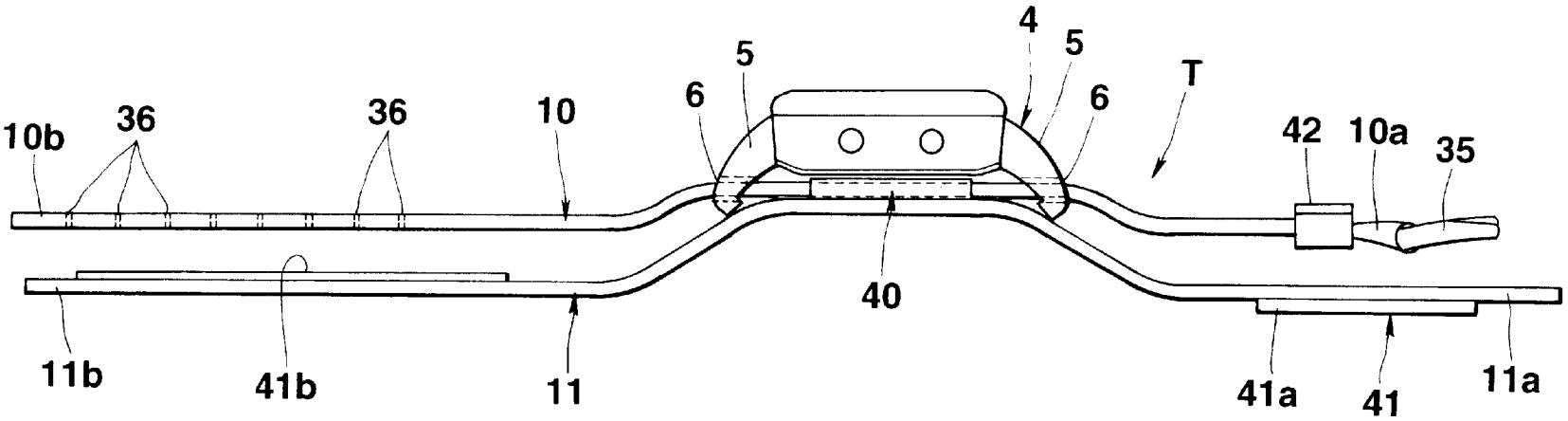
FIG. 16 is a side view showing the watch band according to an eleventh embodiment of the invention.
Figure 17:
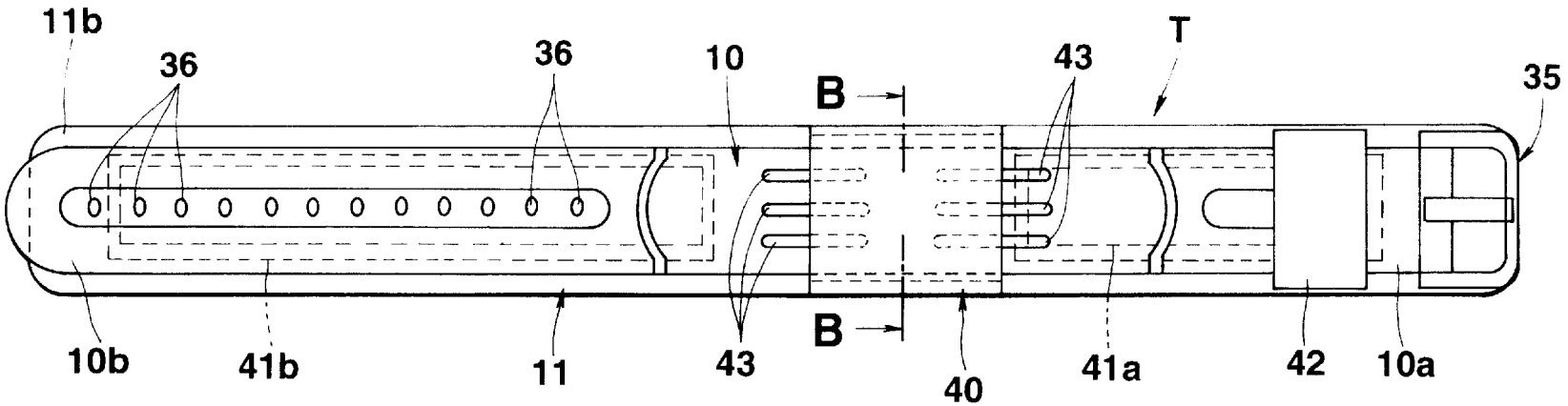
FIG. 17 is a plan view of the watch band shown in FIG. 16.
Figure 18:
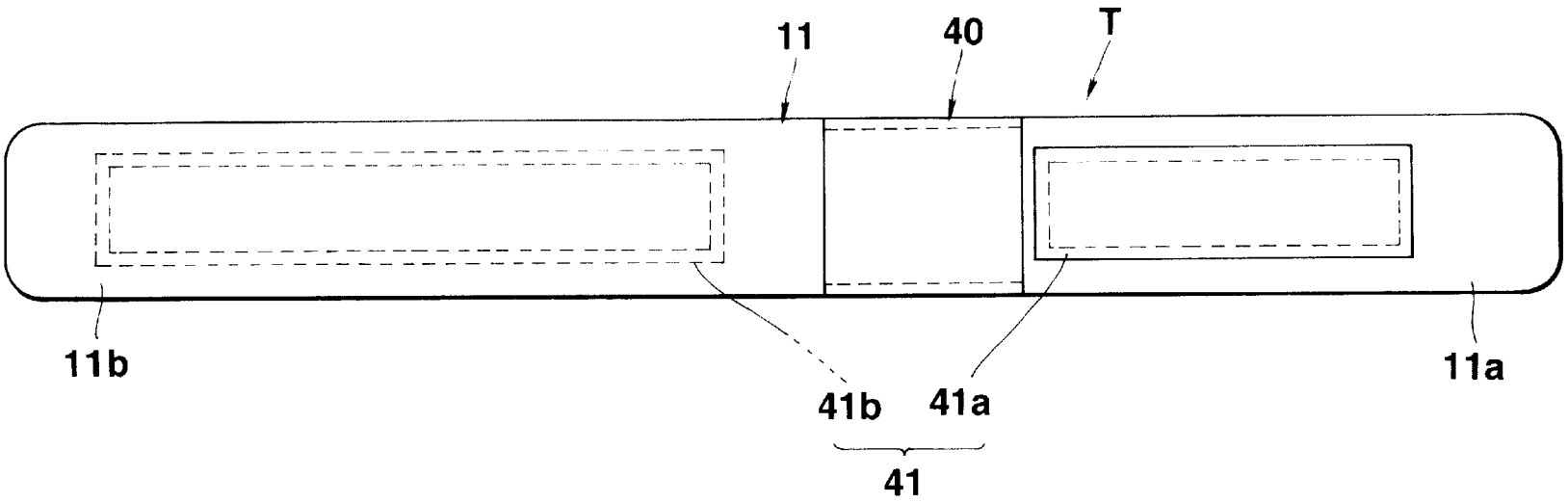
FIG. 18 is a bottom view of the watch band shown in FIG. 16.
Figure 19:
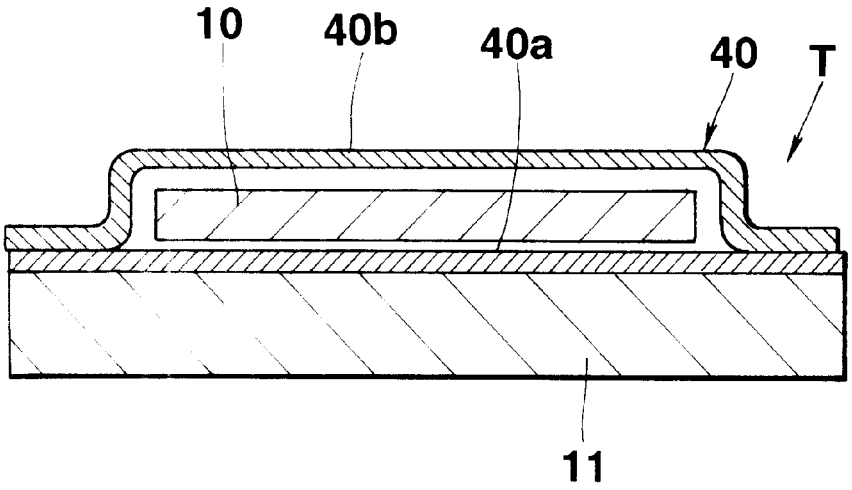
FIG. 19 is an enlarged cross-sectional view taken along the line B—B of FIG. 17.

The holding member 40 is attached to the position for the case complete 4 to be set thereon, on the surface of the second band member 11, which faces to the position therefor of the first band member 10. The holding member 40 comprises a sheet-like member 40*a* which is attached to the facing surface of the second band member 11, which is an upper side in FIG. 19 by sewing or the like, and a securing member 40*b* which is attached to an upper surface of the sheet-like member 40*a*, as shown in FIG. 19. Both sides of the securing member 40*b* along a longitudinal direction of the second band member 11 are attached to the second band member 11 by sewing or the like. Both ends in the longitudinal direction of the securing member 40*b* are opened, so that the first band member 10 will be inserted into an inside thereof, as shown in FIG. 16. The sheet-like member 40*a* and the securing member 40*b* are made of the smooth cloth or the like.

The second fastening member 41 is for fastening the facing surfaces of the overlapped portions of both end portions 11*a* and 11*b* detachably to each other when the second band member 11 is bent to be wound around the wrist. One sheet fastener 41*a* is attached to the lower surface of the right end portion 11*a* of the second band member 11, while the other sheet fastener 41*b* is attached to the upper surface of the left end portion 11*b* of the second band member 11, as shown in FIG. 16. The other sheet fastener 41*b* extends from the left end portion 11*b* of the second band member 11 toward the holding member 40 in order to adjust a wound length to fit it for the size of wrist.

A loop member 42 for securing the left end portion 10*b* of the first band member 10 is attached thereto to be movable in a vicinity of the buckle 35. The loop member 42 comprises: a band-shape member of which length is longer than the width of the first band member 10, which is disposed in the perpendicular to the longitudinal direction of the first band member 10; a cloth for inserting the first band member 10, which is attached to an intermediate portion of the band-shape member; and a fastening portion which comprises a pair of sheet fasteners which are pressed to each other detachably and are attached to facing surfaces of both end portions of the band-shape member, which overlap to face to each other in a state of the band-shape member is bent in a loop shaped, like the holding member 30 in the ninth embodiment shown in FIG. 14. In a vicinity of a position to which the holding member 40 is attached, of the first band member 10, a plurality of slit holes 43 is formed.

In order to attach the case complete 4 to the watch band T, the left end portion 10*b* side of the first band member 10 is inserted into the insertion hole 6 of the band attachment portion 5 on the right side of the case complete 4, the inside of the holding member 40 which is attached to the second band member 11, and the insertion hole 6 of the band attachment portion 5 on the left side of the case complete 4 subsequently, as shown in FIG. 16. As the result, it is possible to attach the first band member 10 to the second band member 11 and to attach the case complete 4 to the first band member 10 easily. In order to change the watch band T, the left end portion 10*b* side of the first band member 10 is pulled out from the insertion hole 6 of the band attachment portion 5 on the left side of the case complete 4, the inside of the holding member 40, and the insertion hole 6 of the band attachment portion 5 on the right side of the case complete 4 subsequently. As the result, it is possible to detach the first band member 10 from the second band member 11 and to detach the case complete 4 from the first band member 10. Therefore, it is possible to change the watch band T easily and speedily. Further, because it is possible to detach the first band member 10 from the second band member 11 completely, it is possible to change the first band member 10 and the second band member 11 to another one and to make various combinations of them as the watch band T.

In order to put the watch band T on the wrist, at first, the second band member 11 is wound around the wrist and the one sheet fastener 41*a* is overlapped the other sheet fastener 41*b* of the second fastening member 41 to secure the second band member 11, so that the second band member 11 can be attached to the wrist. In this state, the first band member 10 is wound around the second band member 11 and the buckle 35 provided on the right end portion 10*a* of the first band member 10 is engaged with the adjusting hole 36 formed in the left end portion 10*b* side. As the result, it is possible to put the watch band T on the wrist. In this case, the other sheet fastener 41*b* of the second fastening member 41 extends from the left end portion 11*b* side toward the holding member 40. Accordingly, it is possible to adjust a fastening position of the pair of sheet fasteners 41*a* and 41*b* to fit it for the size of wrist. Therefore, it is possible to fit the second band member 11 to the wrist well.

In such the watch band T, when both end portions 10*a* and 10*b* of the first band member 10 are connect to each other by engaging the adjusting hole 36 formed in the first band member 10 with the buckle 35, it is possible to secure the left end portion 10*b* of the adjusting hole 36 side of the first band member 10 by being inserted into the loop member 42. When it is hard to insert the left end portion 10*b* of the first band member 10 into the loop member 42, at first, the fastening portion of the loop member 42 is pulled apart and the band-shape member is developed. In this state, by positioning the left end portion 10*b* of the first band member 10 on the band-shape member, and by fastening the left end portion 10*b* of the first band member 10 at the fastening portion by bending the band-shape member in a loop shaped, it is possible to secure the left end portion 10*b* of the first band member 10 certainly. In order to detach the watch band T from the wrist, after releasing the engaging the adjusting hole 36 with the buckle 35, by pulling apart the second fastening member 38, it is possible to detach the first and second band members 10 and 11 from the wrist.

In the eleventh embodiment, the holding member 40 comprises the sheet-like member 40*a* and the securing member 40*b*. However, it is not always required the sheet-like member 40*a*, that is, only the securing member 40*b* can be attached to the second band member 11 directly.

Twelfth Embodiment

Figure 21:
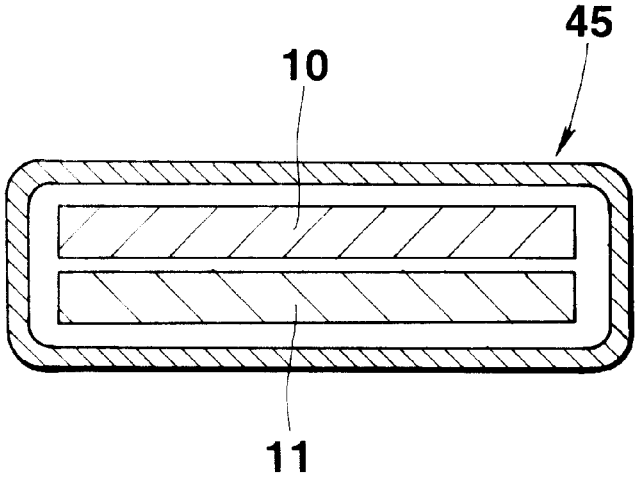
FIG. 21 is an enlarged cross-sectional view of the holding member shown in FIG. 20.
Figure 20:
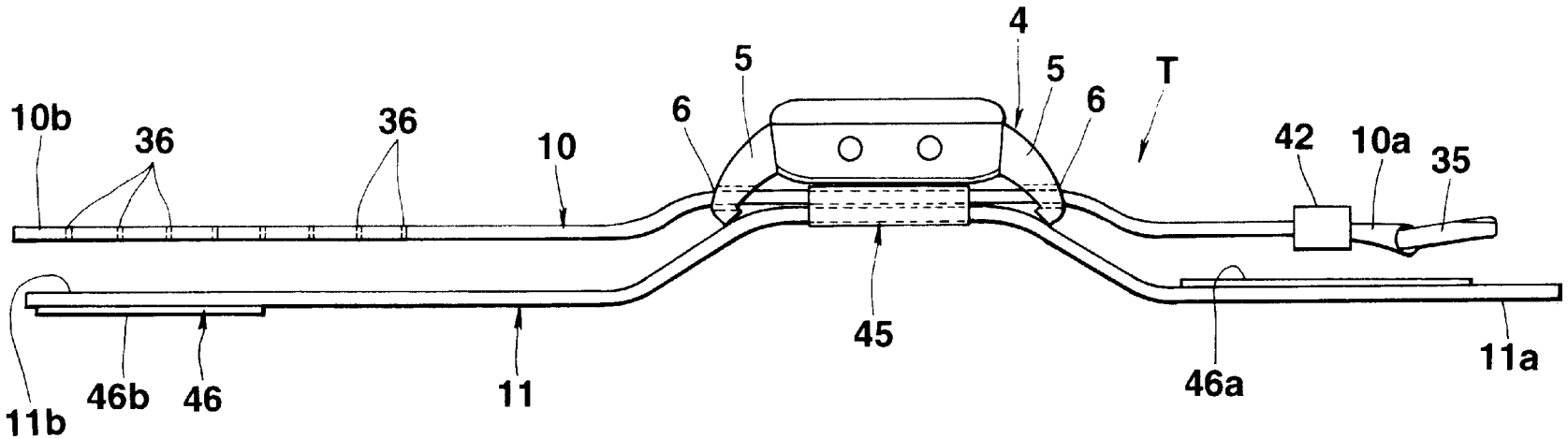
FIG. 20 is a side view showing the watch band according to a twelfth embodiment of the invention.

The twelfth embodiment, in which the present invention is applied for a watch band will be explained with reference to FIGS. 20 and 21. To structural members or the like corresponding to those of the eleventh embodiment shown in FIG. 16, the same reference numerals are attached, and the detailed explanation for them is omitted.

The watch band T has almost the same structure as the eleventh embodiment except that a holding member 45 and a second fastening member 46. The holding member 45 is formed into the loop shaped into which both of the first band member 10 and second band member 11 are inserted to overlap to each other, as shown in FIGS. 20 and 21. The second fastening member 46 comprises one sheet fastener 46*a* which is attached to the upper surface of the right end portion 11*a* side of the second band member 11, and the other sheet fastener 46*b* which is attached to the lower surface of the left end portion 11*b* side of the second band member 11. In this case, the sheet fastener 46*a* positioning on the right side is longer than the sheet fastener 46*b* positioning on the left side.

In order to attach the case complete 4 to the watch band T above-described, the second band member 11 is inserted into the holding member 45 and the holding member 45 is positioned nearly on the intermediate portion of the second band member 11. In this state, the left end portion 10*b* side of the first band member 10 is inserted into the insertion hole 6 of the band attachment portion 5 on the right side of the case complete 4, into the inside of the holding member 45 which is at a position on the intermediate portion of the second band member 11, and into the insertion hole 6 of the band attachment portion 5 on the left side of the case complete 4, like the eleventh embodiment. As the result, it is possible to attach the first band member 10 to the second band member 11 and to attach the case complete 4 to the first band member 10 easily.

In order to change the watch band T, the left end portion 10*b* side of the first band member 10 is pulled out from the insertion hole 6 of the band attachment portion 5 on the left side of the case complete 4, the inside of the holding member 45, and the insertion hole 6 of the band attachment portion 5 on the right side of the case complete 4 subsequently. As the result, it is possible to detach the first band member 10 from the second band member 11 and to detach the case complete 4 from the first band member 10. Therefore, it is possible to change the watch band T easily and speedily. Further, a structure of the holding member 45 is simpler than that of the member in the eleventh embodiment, it is possible to manufacture the watch band T in a low price.

In such a watch band T, because the sheet fastener 46*a* positioning on the right side of the second band member 11 is longer than the sheet fastener 46*b* on the left side thereof, it is possible to adjust a fastening position of the pair of sheet fasteners 46*a* and 46*b* to fit it for the size of wrist. Therefore, it is possible to fit the second band member 11 to the wrist well.

In the twelfth embodiment, after the second band member 11 is inserted into the holding member 45, the first band member 10 is inserted into the holding member 45. However, it is not limited to this. For example, when the first band member 10 is inserted into each insertion hole 6 of the two band attachment portions 5 of the case complete 4, the first band member 10 can be inserted into the holding member 45, so that the holding member 45 will be attached to the first band member 10. In this state, the second band member 11 can be inserted into the holding member 45.

Thirteenth Embodiment

The thirteenth embodiment, in which the present invention is applied for a watch band will be explained with reference to FIGS. 22 and 23. To structural members or the like corresponding to those of the twelfth embodiment shown in FIG. 20, the same reference numerals are attached, and the detailed explanation for them is omitted.

Figure 23A:
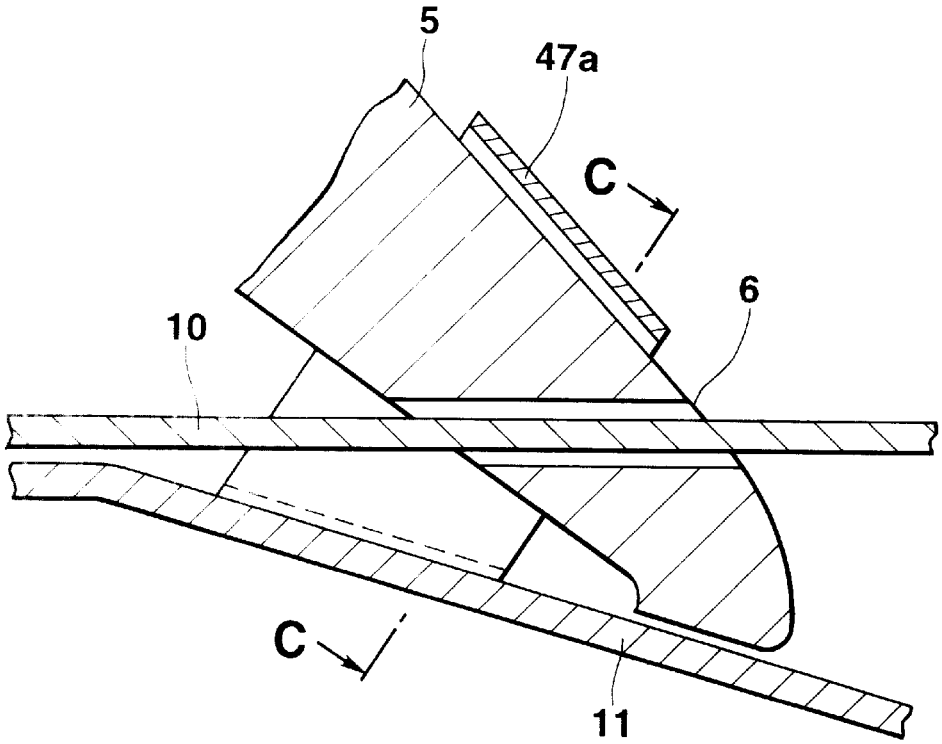
FIGS. 23A and 23B are cross-sectional view showing a main portion of FIG. 22.

A watch band T has almost the same structure as the twelfth embodiment except a holding member 47. The holding member 47 comprises a pair of holding portions 47*a* and 47*b* for wrapping the band attachment portions 5 on the both right and left sides of the case complete 4, which are secured to the second band member 11 by sewing or the like. The holding portion 47*a* on the right side is inserted into the band attachment portion 5 on the right side of the case complete 4 from a lower side so that the insertion hole 6 of the band attachment portion 5 will expose, while the holding portion 47*b* on the left side is inserted into the band attachment portion 5 on the left side of the case complete 4 from a lower side so that the insertion hole 6 of the band attachment portion 5 will expose, as shown in FIG. 23A.

Figure 22:
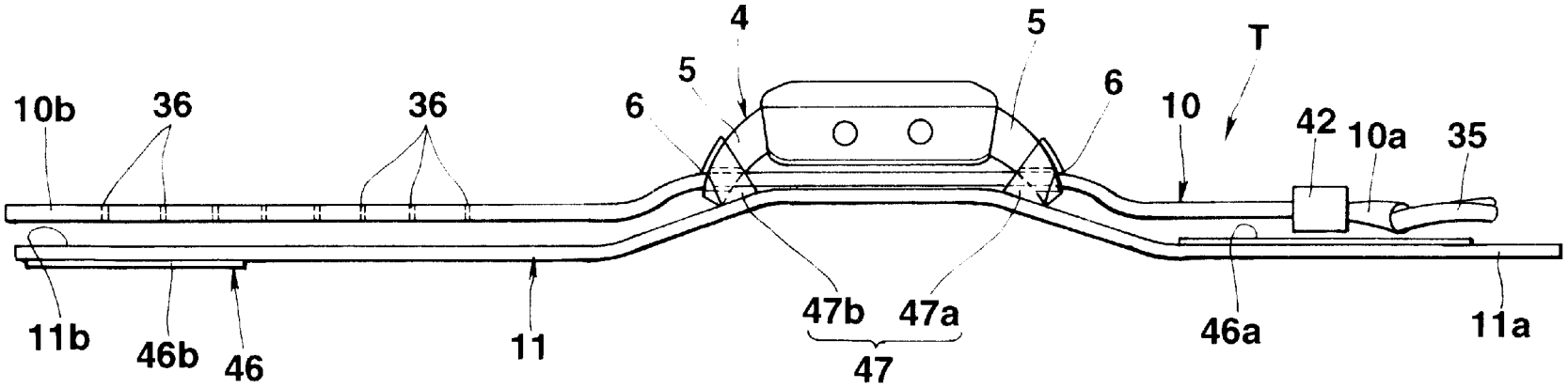
FIG. 22 is a side view showing the watch band according to a thirteenth embodiment of the invention.
Figure 23B:
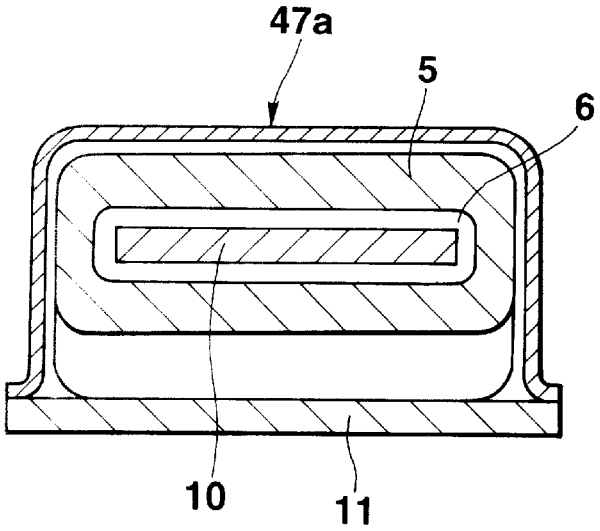

In order to attach the case complete 4 to the watch band T above-described, by attaching each holding portion 47*a* and 47*b* of the holding member 47 disposed on the second band member 11 to the each band attachment portion 5 of the case complete 4, it is possible to attach the case complete 4 to the second band member 11, as shown in FIG. 22. Then, in a state of the insertion hole 6 of the band attachment portion 5 exposes, the left end portion 10*b* side of the first band member 10 is inserted into the insertion hole 6 of the band attachment portion 5 on the right side of the case complete 4, through between the case complete 4 and the second band member 11, and into the insertion hole 6 of the band attachment portion 5 on the left side of the case complete 4, as shown in FIG. 23A. As the result, it is possible to attach the first band member 10 to the second band member 11 and to attach the case complete 4 to the first and second band members 10 and 11 easily.

In order to change the watch band T, the left end portion 10*b* side of the first band member 10 is pulled out from the insertion hole 6 of the band attachment portion 5 on the left side of the case complete 4, through between the case complete 4 and the second band member 11, and from the insertion hole 6 of the band attachment portion 5 on the right side of the case complete 4. As the result, it is possible to detach the first band member 10 from the case complete 4. Thereafter, by detaching each holding portion 47*a* and 47*b* of the holding member 47 from each band attachment portion 5 of the case complete 4, it is possible to detach the case complete 4 from the second band member 11. Therefore, it is possible to change the watch band T easily and speedily.

In the first to thirteenth embodiments, the band in the present invention is applied to the watch band T to which the case complete 4 is attached. However, it is not limited to those.

For example, the band in the present invention can be applied widely to a band to which a wrist member for an accessory, a pedometer, a compass, and the like is attached.

As described above, a band according to an embodiment of the invention, which comprises: the first band member 10; the second band member 11 disposed to overlap on the first band member; and the connecting member 12, 13, or 27 which is attached to at least one of the first and second band members to connect the first and second band members with each other, as shown in FIGS. 1 to 23.

The connecting member is the loop 12, 17, or 20 which is attached to the side of the second band member, to be movable in the longitudinal direction thereof, as shown in FIGS. 1 to 6, 8, 9, and 13.

The connecting member can be the holding member 27 or 30 which is disposed on the side of the second band member, as shown in FIGS. 9 to 14. In this case, at least one of the first and second band members is attached to the inside of the holding member 27 detachably, as shown in FIGS. 9 to 12.

The connecting member can be the fastening member 13, 15, or 25 which is disposed on the surfaces of the first band member and the second band member, which face to each other, to fasten the first band member and the second band member to each other detachably, as shown in FIGS. 1 to 6, and 8.

The connecting member can be comprising two members, one of which is the loop 12 and the other of which is the holding member 27, as shown in FIG. 9.

Figure 13:
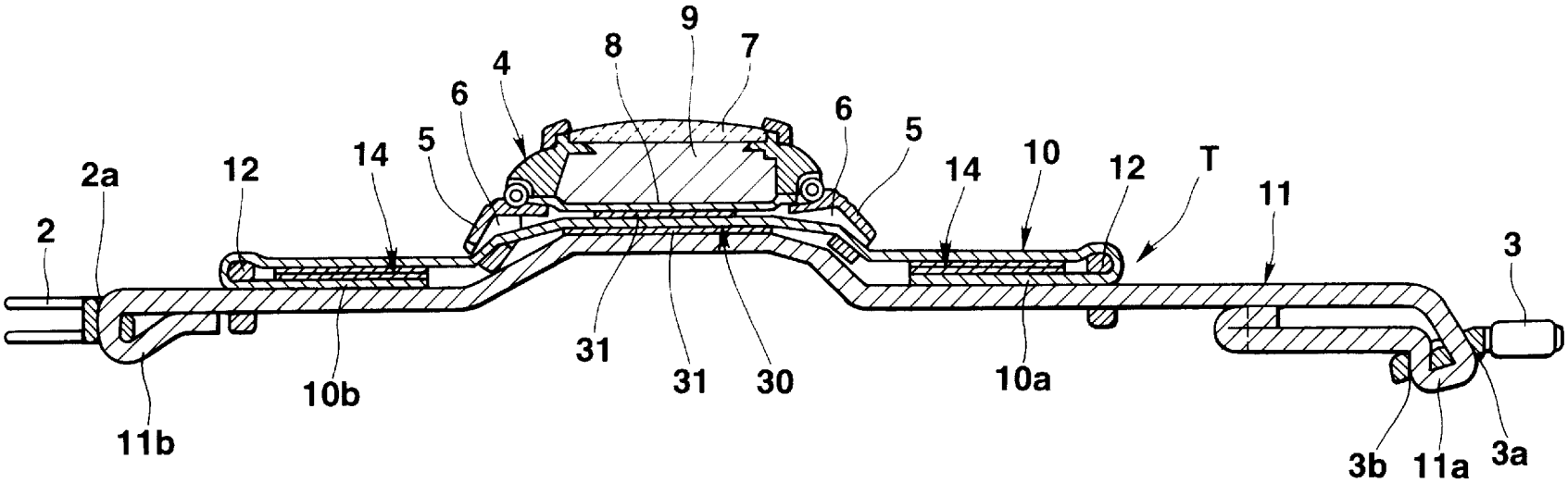
FIG. 13 is a cross-sectional view showing the watch band according to a ninth embodiment of the invention.
Figure 14A:
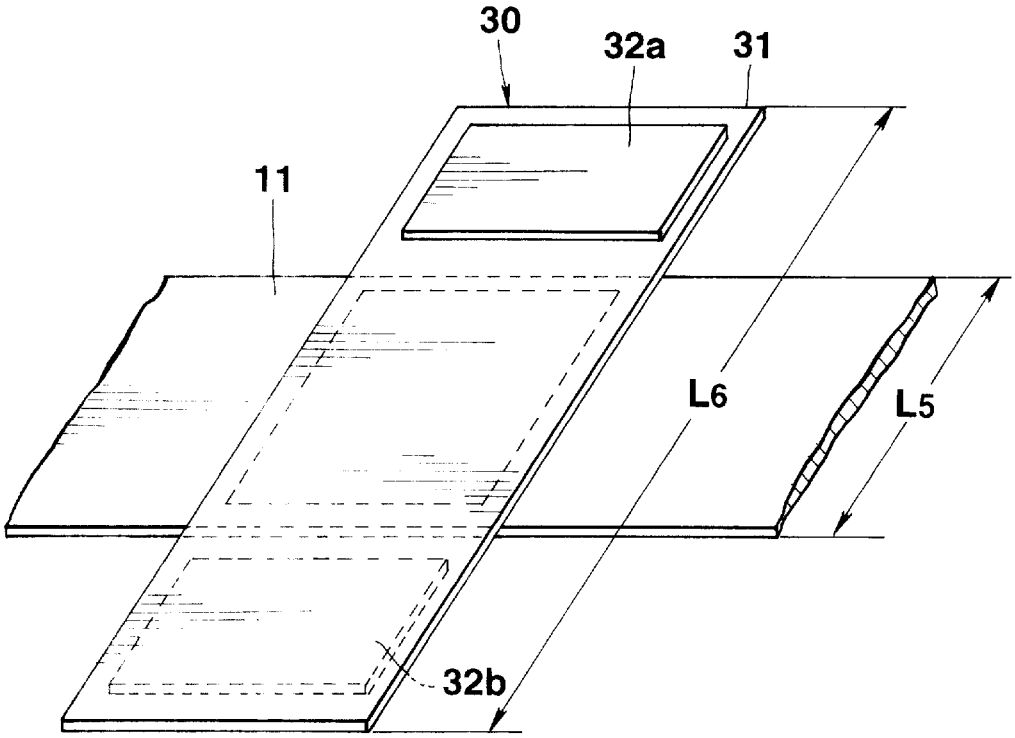
Figure 14B:
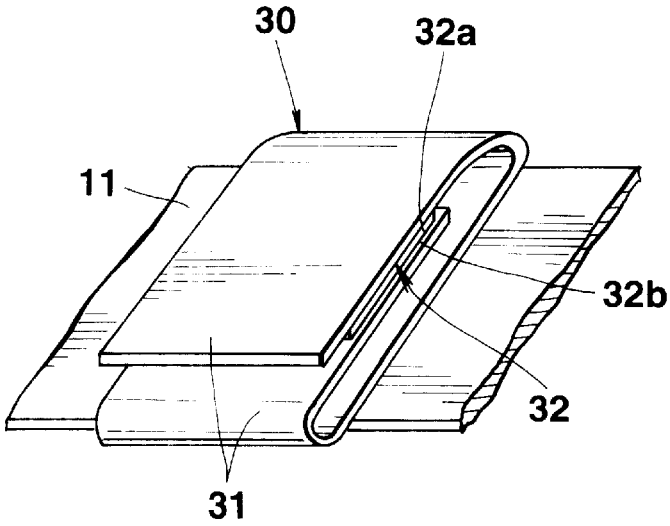

The connecting member can be comprising two members, one of which is the loop 12 and the other of which is the fastening member 13, as shown in FIG. 13.

The end portion 10*a* of the first band member is attached to the second band member through the connecting member detachably, while the other end portion 10*b* of the first member is secured to the second band member, as shown in FIGS. 1, 3 to 6, 8, and 9.

The connecting member comprises the first and second connecting members 12 and 12, both end portions 10*a* and 10*b* of the first band member are attached to the second band member through the first and second connecting members detachably, as shown in FIG. 13.

The end portion 10*a* of the first band member is turned back after inserted into the loop 20 and the turned end portion is inserted into the loop again to provisionally secure to the loop, as shown in FIG. 6.

The first insertion hole 21 into which both of the first band member 10 and the second band member 11 are inserted to overlap to each other; and the second insertion hole 22 into which the end portion of the first band member which was inserted into the first insertion hole is further inserted; are formed in the loop 20, as shown in FIG. 6.

The band further comprises the subsidiary fastening member 14, 16, or 26 for the first band member, which is fastened the connecting member detachably and is provided at the end portion 10*a* of the first band member, as shown in FIGS. 1 to 6, 8, 9, and 13.

The band further comprises the subsidiary fastening member 38 or 41 for the second band member, which fastens each end portion 11*a* and 11*b* of the second band member to each other detachably when the second band member is bent in a circle shape, as shown in FIGS. 15 and 16.

The fastening member comprises the sheet fastener 13, 15, 25, or 37, as shown FIGS. 1 to 6, 8, 9, 13, and 15.

The sheet fastener is disposed over from the intermediate portion of the second band member to the end portion thereof, as shown in FIG. 15.

The first band member is made of the elastic member, while the second band member is made of the inelastic member, as shown in FIGS. 1 to 6, 8, 9, and 13.

A wrist member (4) is attached to the first band member detachably, as shown in FIGS. 1 to 6, 8, 9, 13, 15, 16, 20, and 22.

The wrist member is a wristwatch 4 and the wristwatch is attached to the first band member detachably through the band attachment portions 5 and 5 of the wristwatch, as shown in FIGS. 1 to 6, 8, 9, 13, 15, 16, 20, and 22.

As described above, according to the invention, by detaching the first band member and the second band member, which are connected to each other by the connecting member, it is possible to release the first band member and the second band member, which are in the overlapped state. As the result, it is possible to detach the wrist member, for example, the wristwatch or the like attached to the first band member, from the first band member or the second band member easily and speedily. It is also possible to attach the wrist member, e.g., the wristwatch or the like, to the first band member or the second band member easily and speedily. Therefore, it is possible to change the band easily and speedily.

What is claimed is:

1. A band comprising:

a first band member adapted to be passed through insertion holes formed in a pair of band attachment portions extending opposite to each other from a periphery of a case complete;

a second band member disposed under the first band member so as to be overlapped by the first band member; and a connecting member disposed at a position between the pair of band attachment portions for connecting the first and second band members with each other at a position between the pair of band attachment portions extending from the case complete where the first and second band members overlap, said connecting member having a shape of a tube having open ends in a longitudinal direction of the first and second band members;

wherein a first side portion of the connecting member is secured to the second member, and the first band member is inserted into an inside of the connecting member, and a surface at a second side portion of the connecting member is brought into contact with a case back of the case complete.

2. The band as claimed in claim 1, further comprising a loop attached to one end of the first band member and also attached to the second band member, so as to be movable in the longitudinal direction of the second band member.

3. The band as claimed in claim 2, wherein an end portion of the first band member is turned back after being inserted into the loop, and the turned back end portion is provisionally secured to a portion of the first band member adjacent to the end portion.

4. The band as claimed in claim 1, wherein the first band member is made of an elastic material and the second band member is made of an inelastic material.

* * * * *